US010960254B2

(12) United States Patent
Hurlbut

(10) Patent No.: US 10,960,254 B2
(45) Date of Patent: Mar. 30, 2021

(54) EXERCISE DEVICE

(71) Applicant: GH Product Design and Development, LLC, Seattle, WA (US)

(72) Inventor: Gary Hurlbut, Seattle, WA (US)

(73) Assignee: GH PRODUCT DESIGN AND DEVELOPMENT, LLC, Seattle, WA (US)

( * ) Notice: Subject to any disclaimer, the term of this patent is extended or adjusted under 35 U.S.C. 154(b) by 79 days.

(21) Appl. No.: 16/044,316

(22) Filed: Jul. 24, 2018

(65) Prior Publication Data

US 2020/0030656 A1 Jan. 30, 2020

(51) Int. Cl.

| | |
|---|---|
| ***A63B 21/04*** | (2006.01) |
| ***A63B 21/00*** | (2006.01) |
| ***A63B 23/12*** | (2006.01) |
| ***A63B 23/035*** | (2006.01) |
| ***A63B 21/055*** | (2006.01) |

(52) U.S. Cl.

CPC ..... *A63B 21/0414* (2013.01); *A63B 21/0552* (2013.01); *A63B 21/4035* (2015.10); *A63B 23/03508* (2013.01); *A63B 23/1209* (2013.01); *A63B 2208/0204* (2013.01)

(58) Field of Classification Search

CPC ..... A63B 21/0414; A63B 21/0552; A63B 23/03508; A63B 23/1209; A63B 21/4035; A63B 2208/0204; A63B 1/00; A63B 2225/09; A63B 2209/10; A63B 2210/50; A63B 2209/00; A63B 2225/10

See application file for complete search history.

(56) References Cited

U.S. PATENT DOCUMENTS

| | | | | |
|---|---|---|---|---|
| 3,427,023 | A * | 2/1969 | Silberman | A63B 21/4043 482/139 |
| 3,589,721 | A * | 6/1971 | Cronauer | A63B 21/0004 482/125 |
| 4,059,265 | A | 11/1977 | Wieder et al. | |
| 4,328,964 | A * | 5/1982 | Walls | A63B 21/4035 473/229 |
| 4,618,143 | A * | 10/1986 | Twardosz | A63B 21/0724 482/106 |
| 4,690,400 | A * | 9/1987 | Metz | A63B 21/015 482/106 |
| RE33,218 | E | 5/1990 | Twardosz | |
| 5,024,434 | A * | 6/1991 | Smith | A63B 21/0724 482/106 |
| 5,312,308 | A * | 5/1994 | Hamilton | A63B 21/072 482/44 |
| 5,380,261 | A * | 1/1995 | Mora | A63B 21/153 482/109 |

(Continued)

FOREIGN PATENT DOCUMENTS

DE 10242287 A1 3/2004

*Primary Examiner* — Garrett K Atkinson

(74) *Attorney, Agent, or Firm* — Seed Intellectual Property Law Group LLP

(57) ABSTRACT

In one embodiment a fitness device is disclosed. The fitness device may include a central handle having a body with a central aperture through the body. The device may also include a first end cap having a ring removably coupled to the central handle at a first location and a second end cap having a ring removably coupled to the central handle at a second location, opposite the first location.

20 Claims, 27 Drawing Sheets

(56) References Cited

U.S. PATENT DOCUMENTS 5,478,297 A * 12/1995 Dennis, Jr. ..... A63B 5/20 482/81
5,549,532 A 8/1996 Kropp
5,620,398 A * 4/1997 Moriarty ..... A63B 21/153 482/46
5,718,654 A * 2/1998 Kennedy ..... A63B 21/154 482/102
5,746,687 A 5/1998 Vial et al.
5,799,937 A * 9/1998 Nolan ..... A63B 15/00 473/457
5,885,196 A 3/1999 Gvoich
5,941,799 A * 8/1999 Bergdorf ..... A63B 23/14 482/126
6,106,438 A * 8/2000 Dean ..... A63B 23/14 127/45
6,152,858 A * 11/2000 Kolb ..... A63B 23/14 482/100
6,371,866 B1 * 4/2002 Rivera ..... A63B 53/00 473/288
6,497,641 B1 * 12/2002 Hinds ..... A63B 21/00043 482/121
6,648,804 B2 * 11/2003 Chen ..... A63B 21/0004 482/125
6,652,420 B2 * 11/2003 Chen ..... A63B 23/12 482/139
6,676,576 B1 * 1/2004 Wu ..... A63B 21/0004 482/126
6,860,841 B1 * 3/2005 Mortorano ..... A63B 21/0004 482/126
D520,575 S * 5/2006 Diakonov ..... D21/679
7,041,041 B1 5/2006 Evans
7,094,182 B1 * 8/2006 Holten ..... A63B 23/14 482/115
7,094,186 B2 * 8/2006 Diakonov ..... A63B 21/0728 482/104
7,147,592 B2 * 12/2006 Hinds ..... A63B 21/0552 482/126
D535,336 S * 1/2007 Diakonov ..... D21/679
7,322,907 B2 * 1/2008 Bowser ..... A63B 21/04 482/121
7,326,157 B2 2/2008 Wu
7,377,886 B2 * 5/2008 Wu ..... A63B 21/0004 482/121
7,377,888 B2 5/2008 Godbold
7,381,166 B2 * 6/2008 Bazinet ..... A63B 5/22 482/79
7,431,680 B1 * 10/2008 Hinds ..... A63B 21/0552 482/44
7,448,990 B2 * 11/2008 Wu ..... A63B 21/0004 482/121
7,465,258 B1 * 12/2008 Mortorano ..... A63B 21/0004 482/126
7,465,259 B2 * 12/2008 Mok ..... A63B 21/0004 482/121
7,578,775 B2 * 8/2009 Terry ..... A63B 21/0004 482/121
7,625,324 B1 * 12/2009 Hinds ..... A63B 21/4017 482/121
7,862,486 B1 * 1/2011 Watson ..... A63B 21/0724 482/106
7,922,634 B1 * 4/2011 Wu ..... A63B 21/0004 482/121
7,931,542 B2 * 4/2011 Kusumoto ..... A63B 53/02 473/288
7,958,881 B2 6/2011 Silverson
7,967,021 B2 * 6/2011 Montgomery ..... A45B 3/00 135/66
8,075,462 B1 * 12/2011 Hinds ..... A63B 21/4025 482/125
8,079,942 B2 * 12/2011 Anderson ..... F41B 5/14 482/121
8,088,047 B2 * 1/2012 Marji ..... A63B 5/20 482/82
D671,996 S * 12/2012 Wierszewski ..... D21/680
8,491,446 B2 * 7/2013 Hinds ..... A63B 21/0055 482/126
8,556,781 B1 * 10/2013 Fitzpatrick ..... A63B 21/0724 482/106
8,602,951 B2 * 12/2013 Morris ..... A63B 21/0004 403/202
8,821,355 B2 * 9/2014 Daniels ..... A63B 5/20 482/82
8,876,678 B2 * 11/2014 Flentye ..... A63B 21/0552 482/121
8,944,975 B2 * 2/2015 Hsieh ..... A63B 21/0442 482/124
8,961,379 B2 * 2/2015 Flentye ..... A63B 21/0552 482/121
8,986,173 B1 * 3/2015 Adams ..... A63B 21/028 482/106
8,986,174 B2 * 3/2015 Lien ..... A63B 21/0724 482/106
9,186,535 B2 * 11/2015 Ercanbrack ..... A63B 21/4033
9,254,408 B1 2/2016 Otto
9,713,734 B1 * 7/2017 Hurlbut ..... A63B 21/4035
D797,217 S * 9/2017 Gilbert ..... D21/681
9,855,459 B1 * 1/2018 Condara ..... A63B 21/4035
10,065,063 B1 * 9/2018 Hurlbut ..... A63B 21/0552
10,159,868 B2 * 12/2018 Light ..... A63B 21/4049
2005/0037904 A1 2/2005 Chang et al.
2005/0075223 A1 * 4/2005 Wu ..... A63B 21/0004 482/126
2005/0239617 A1 10/2005 Tenaglia
2006/0052223 A1 * 3/2006 Terry ..... A63B 21/0004 482/126
2006/0094573 A1 * 5/2006 Weck ..... A63B 21/0552 482/126
2006/0105893 A1 * 5/2006 Chen ..... A63B 21/00043 482/126
2007/0004527 A1 * 1/2007 Helmstetter ..... A63B 53/02 473/282
2007/0032354 A1 * 2/2007 Bazinet ..... A63B 5/22 482/81
2008/0287272 A1 11/2008 Luckadue
2009/0192025 A1 7/2009 Minerva
2010/0035701 A1 * 2/2010 Kusumoto ..... A63B 60/54 473/307
2010/0152002 A1 * 6/2010 Knight ..... A63B 21/0552 482/93
2011/0301000 A1 * 12/2011 Pullen ..... A61H 1/0292 482/109
2012/0094812 A1 4/2012 Smiley
2013/0035218 A1 * 2/2013 Wierszewski ..... A63B 21/072 482/106
2013/0288864 A1 * 10/2013 Holland ..... A63B 21/00065 482/126
2013/0340735 A1 * 12/2013 Emory ..... F41B 5/1403 124/23.1
2014/0038793 A1 2/2014 Hetzel
2014/0045661 A1 * 2/2014 Lien ..... A63B 21/4049 482/108
2014/0228180 A1 * 8/2014 Walker ..... A63B 21/065 482/82
2014/0366858 A1 12/2014 Garver et al.
2016/0074692 A1 * 3/2016 Vial ..... A63B 21/0442 482/122
2020/0121985 A1 * 4/2020 Ju ..... A63B 21/023

* cited by examiner

EXERCISE DEVICE

BACKGROUND

Technical Field

This disclosure generally relates to exercise equipment.

Description of the Related Art

Maintaining good physical fitness and range of motion is difficult for many people. They may be intimidated by gyms, and the large bulky exercise equipment usually associated with gyms or they may find it difficult to make the time to travel to the gym for a workout. Some people travel often and despite good fitness habits at home, the stress of travel and the lack of suitable equipment in many hotels can cause people to skip workouts. Still other people may lack the strength to lift some of the heavier workout equipment, or a doctor or trainer may recommend only light resistance workouts. While many devices exist that may fulfill some exercise needs, they are often single task devices suitable for a few select workouts that lack greater adjustability and suitability for various exercises.

BRIEF SUMMARY

In one embodiment a fitness device is disclosed. The fitness device may include a central handle having a body with a central aperture through the body. The device may also include a first rod removably coupled to the central handle at a first location and a second rod removably coupled to the central handle at a second location, opposite the first location. The device may also include an elastic member having a first end and a second end, the first end being coupled to the first rod and the second end being coupled to the second rod.

The fitness device may further include a first coupling that couples the first rod to the central handle and a second coupling that couples the second rod to the central handle. The first and second couplings may be collets. The fitness device may further include a first resistance adjuster coupled to the first rod and a second resistance adjuster coupled to the second rod, the elastic member passing through the first and second resistance adjusters, the first and second resistance adjusters being configured to slide along a respective length of the first and second rods.

The fitness device may further include a first handle positionable along a length of the first rod and a second handle positionable along a length of the second rod. The fitness device may further include a first resistance adjuster coupled to the first handle and a second resistance adjuster coupled to the second handle, the elastic member passing through the first and second resistance adjusters. The first and second handles may each include a collet configured to engage with a respective one of the first and second rods and configured to resist movement of the first and second handles along the respective lengths of the first and second rods.

In another embodiment a fitness device may include a central handle including a first handle member extending between a first coupling and a second coupling and a second handle member extending between the first coupling and the second coupling, the first and second handle members forming at least a portion of a central aperture through the central handle. The fitness device may also include a first rod removably coupled to the central handle at a first location and a second rod removably coupled to the central handle at a second location, opposite the first location. The device may also include an elastic member having a first end and a second end, the first end being coupled to the first rod and the second end being coupled to the second rod.

The fitness device may further include a first handle including a body having a channel formed along a length of the body, the first handle being positionable along a length of the first rod, and a second handle including a body having a channel formed along a length of the body, the second handle being positionable along a length of the second rod. The fitness device may further include a first handle positionable along a length of the first rod and a second handle positionable along a length of the second rod. The fitness device may further include a first resistance adjuster coupled to the first rod and a second resistance adjuster coupled to the second rod, the elastic member passing through the first and second resistance adjusters, the first and second resistance adjusters being configured to slide along a respective length of the first and second rods.

The fitness device may further include a first handle positionable along a length of the first rod, the first resistance adjuster being integral with the first handle, and a second handle positionable along a length of the second rod, the second resistance adjuster being integral with the second handle. The fitness device may further include at least one interchangeable weight configured to be removably coupled to the central handle.

In yet another embodiment, a fitness device may include a central handle, a first rod coupled to the central handle, and a second rod coupled to the central handle. The fitness device may also include an elastic member having a first end and a second end, the first end being coupled to the first rod and the second end being coupled to the second rod. The device may also include a first resistance adjuster coupled to the first rod and a second resistance adjuster coupled to the second rod. The elastic member may pass through the first and second resistance adjusters.

The fitness device may further include a first handle positionable along a length of the first rod and a second handle positionable along a length of the second rod. The fitness device may further include at least one interchangeable weight configured to be removably coupled to the central handle. The first resistance adjuster may be integral with the first handle and the second resistance adjuster may be integral with the second handle. The first rod may be removably coupled to the central handle and the second rod may be removably coupled to the central handle.

The first and second resistance adjusters may each include a clamp configured to be releasably engaged with a respective one of the first and second rods and resist movement of the respective adjuster along the length of the respective rods. The fitness device may further include a first aperture through the first handle and a second aperture through the second handle, the elastic member passing through the first aperture and the second aperture.

In another embodiment, a method of using an exercise device comprises: holding a ring-shaped handle of the exercise device in a first hand; holding an elastic member of the exercise device in a second hand; pulling the elastic member away from the ring-shaped handle against a resistance of the elastic member; coupling one or more plate weights to the ring-shaped handle; and lifting the ring-shaped handle and the one or more plate weights.

During the pulling of the elastic member away from the ring-shaped handle, the exercise device may include a first rod, a proximal end of the first rod coupled to the ring-shaped handle at a first coupling at a first location, and a second rod, a proximal end of the second rod coupled to the ring-shaped handle at a second coupling at a second location opposite to the first location across a diameter of the ring-shaped handle. During the pulling of the elastic member away from the ring-shaped handle, a first end of the elastic member may be coupled to a distal end of the first rod and a second end of the elastic member may be coupled to a distal end of the second rod. During the pulling of the elastic member away from the ring-shaped handle, the exercise device may include a first adjustable handle adjustably coupled to the first rod, wherein adjusting the position of the first adjustable handle along a length of the first rod changes the resistance of the elastic member.

During the pulling of the elastic member away from the ring-shaped handle, the exercise device may include a second adjustable handle adjustably coupled to the second rod, wherein adjusting the position of the second adjustable handle along a length of the second rod changes the resistance of the elastic member. The method may further comprise, after pulling the elastic member and before coupling one or more plate weights to the ring-shaped handle, removing the first rod and the second rod from the first and second couplings and from the ring-shaped handle. Coupling one or more plate weights to the ring-shaped handle may comprise, after removing the first rod and the second rod from the first and second couplings, coupling the one or more plate weights to the first and second couplings.

In another embodiment, an exercise device comprises: a ring-shaped handle including an opening extending through a center of the ring-shaped handle, a first coupling at a first location, the first coupling having a first cylindrical outer surface with a first outer diameter of about 5 cm, and a second coupling at a second location opposite to the first location across a diameter of the ring-shaped handle, the second coupling having a second cylindrical outer surface with a second outer diameter of about 5 cm; a first rod, a proximal end of the first rod removably coupled to the ring-shaped handle at the first coupling; a second rod, a proximal end of the second rod removably coupled to the ring-shaped handle at the second coupling; and an elastic member, a first end of the elastic member coupled to a distal end of the first rod, and a second end of the elastic member coupled to a distal end of the second rod.

The exercise device may further comprise a first adjustable handle adjustably coupled to the first rod, wherein adjusting a position of the first adjustable handle along a length of the first rod changes a resistance of the elastic member to being pulled away from the ring-shaped handle. The exercise device may further comprise a second adjustable handle adjustably coupled to the second rod, wherein adjusting a position of the second adjustable handle along a length of the second rod changes the resistance of the elastic member to being pulled away from the ring-shaped handle.

An exercise device may comprise a ring-shaped handle including an opening extending through a center of the ring-shaped handle, a first coupling at a first location, and a second coupling at a second location opposite to the first location across a diameter of the ring-shaped handle; an elastic member; a first rod, a proximal end of the first rod coupled to the first coupling, a distal end of the first rod coupled to a first end of the elastic member; a second rod, a proximal end of the second rod coupled to the second coupling, a distal end of the second rod coupled to a second end of the elastic member; a first adjustable handle adjustably coupled to the first rod, wherein adjusting a position of the first adjustable handle along a length of the first rod changes a resistance of the elastic member to being pulled away from the ring-shaped handle, the first adjustable handle including a first cam lock to lock the first adjustable handle to the first rod; and a second adjustable handle adjustably coupled to the second rod, wherein adjusting a position of the second adjustable handle along a length of the second rod changes the resistance of the elastic member to being pulled away from the ring-shaped handle, the second adjustable handle including a second cam lock to lock the second adjustable handle to the second rod.

The first coupling may have a first cylindrical outer surface with a first outer diameter of about 5 cm and the second coupling may have a second cylindrical outer surface with a second outer diameter of about 5 cm. The first adjustable handle may include a first shackle and the elastic member may extend through the first shackle, and the second adjustable handle may include a second shackle and the elastic member may extend through the second shackle. The first rod may have a first central longitudinal axis, the second rod may have a second central longitudinal axis coincident with the first central longitudinal axis, and the opening extending through the center of the ring-shaped handle may have a third central longitudinal axis that is perpendicular to the first and second central longitudinal axes. The first and second couplings may be first and second collet couplings.

The first adjustable handle may include: a hollow cylindrical body having a side wall with a circumferential opening adjacent to a proximal end of the first adjustable handle; and a clip rotatably mounted within the circumferential opening so that the clip can be rotated inward toward the hollow cylindrical body to engage the first cam lock and outward away from the hollow cylindrical body to disengage the first cam lock. A first circumferential end of the circumferential opening may include a first bearing for rotatably mounting the clip to the hollow cylindrical body and a second circumferential end of the circumferential opening opposite to the first circumferential end may include a partial wall that extends from an inner surface of the hollow cylindrical body partially outward through the thickness of the hollow cylindrical body. A first end of the clip may include a second bearing for engaging with the first bearing, and the first end of the clip may have an outer profile that forms a cam surface of the cam lock.

An exercise device may be summarized as comprising: a ring-shaped handle including an opening extending through a center of the ring-shaped handle; a first coupling at a first location, the first coupling having a first threaded outer surface with a first outer diameter of about 5 cm and a first threaded inner surface; and a second coupling at a second location opposite to the first location across a diameter of the ring-shaped handle, the second coupling having a second threaded outer surface with a second outer diameter of about 5 cm and a second threaded inner surface.

The first threaded inner surface may be threaded in a direction opposite to the first threaded outer surface. The second threaded inner surface may be threaded in a direction opposite to the second threaded outer surface. The first threaded inner surface may be threaded in a direction the same as the second threaded inner surface and the first threaded outer surface may be threaded in a direction the same as the second threaded outer surface. The first and second threaded inner surfaces may have left-handed threads and the first and second threaded outer surfaces may have right-handed threads. The exercise device may further comprise a first collar threaded onto the first threaded outer surface and a second collar threaded onto the second threaded outer surface. The exercise device may further comprise a first end cap threaded into the first threaded inner surface and a second end cap threaded into the second threaded inner surface.

An exercise device may be summarized as comprising: a ring-shaped handle including an opening extending through a center of the ring-shaped handle; a first coupling at a first location, the first coupling having a first threaded inner surface; a second coupling at a second location opposite to the first location across a diameter of the ring-shaped handle, the second coupling having a second threaded inner surface; a first end cap threaded into the first threaded inner surface; and a second end cap threaded into the second threaded inner surface.

The first end cap may have a first distal end and includes a first ring at the first distal end. The first ring may have a first central longitudinal axis and may be rotatable with respect to the ring-shaped handle about the first central longitudinal axis. The second end cap may have a second distal end and may include a second ring at the second distal end. The second ring may have a second central longitudinal axis that is coincident with the first central longitudinal axis and may be rotatable with respect to the ring-shaped handle about the second central longitudinal axis. The first end cap may be positioned within and threaded into a conduit that extends through the first coupling and the second coupling. The second end cap may be positioned within and threaded into the conduit that extends through the first coupling and the second coupling.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with the technology have not been shown or described in detail to avoid unnecessarily obscuring descriptions of the embodiments.

Figure 1:
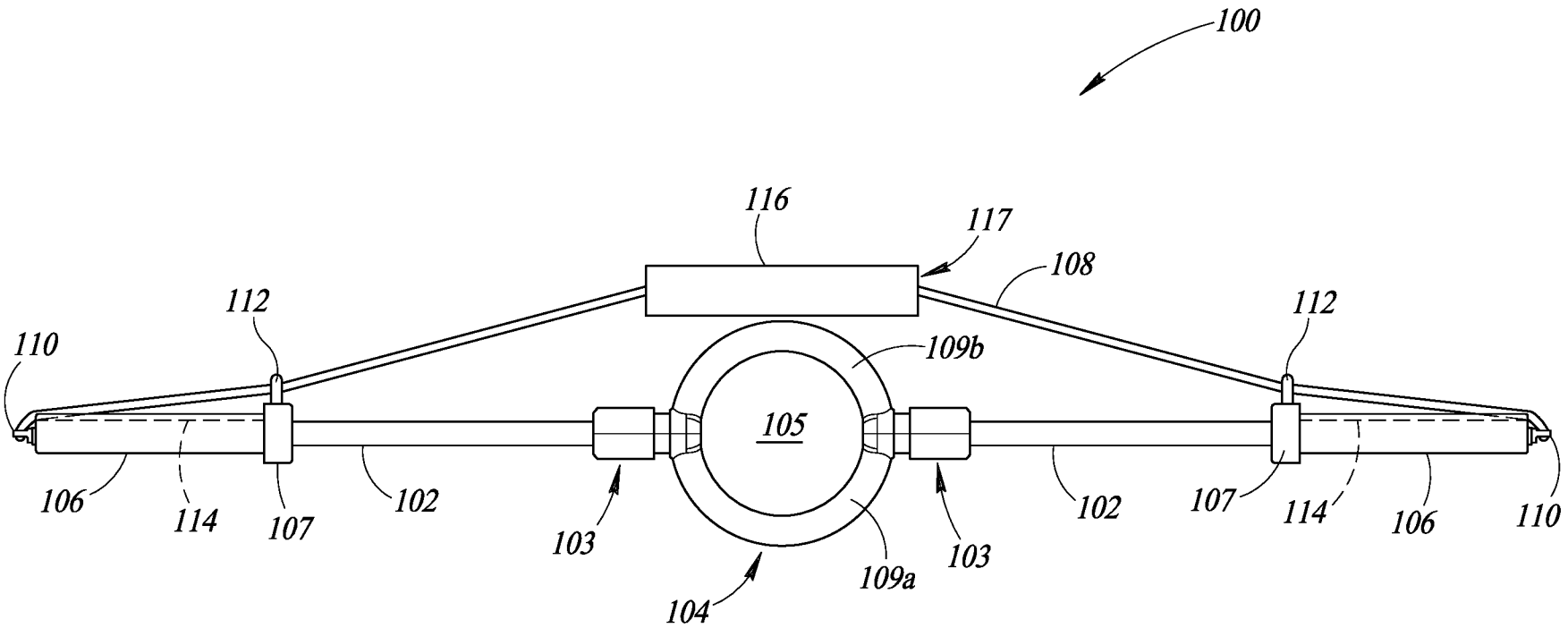
FIG. 1 depicts an elastic resistance device according to one or more embodiments disclosed herein.

FIG. 1 shows an elastic fitness device 100 including two rods 102 that extend from, and are coupled to, a central handle 104 and an elastic member 108 that is coupled to the respective ends of each rod 102. The rods 102 are coupled to the central handle 104 via couplings 103, which may be collets or another type of coupling. The rods 102 are equal length and may be made from one or more materials, such as aluminum, carbon, carbon fiber, plastic, wood, composite materials, or other materials. In some embodiments, the rods 102 may be multi-piece rods or, as depicted in FIG. 1, each rod 102 may be a single unitary member.

The couplings 103 allow the elastic fitness device 100 to be taken apart for storage and travel.

The body of the central handle 104 depicted in FIG. 1 has two handle members 109*a*, 109*b* that extend opposite each other and between the couplings 103. The two handle members 109*a*, 109*b* provide strength and stiffness to the elastic fitness device 100 as compared to a device that includes a central handle having only a single member. During use, the two handle members 109*a*, 109*b*, spread the forces imparted on the device between both handle members 109*a*, 109*b* with one handle member 109*a*, 109*b* in compression while the other handle member 109*a*, 109*b* is in tension.

The central handle 104 has an annular, circular shape with a central aperture 105. In other embodiments, the central handle 104 may have a square or rectangular shape with a central aperture.

The elastic member 108 may be an elastic cord, such as surgical tubing, shock cord (an elastic cord including one or more elastic strands forming a core that may be covered in a woven sheath), or other elastic material. Each end of the elastic member 108 is coupled to a respective end of the rods 102 of the elastic fitness device 100. The ends of the rods 102 may include a coupling 110, which may be, for example, a ring or eyelet through with the elastic member 108 is tied. In some embodiments, the elastic member 108 may be coupled to the end of the rods or to the coupling 110 via other couplers, such as clips or carabiners.

The elastic fitness device 100 may also include a handle 116 on the elastic member 108. The handle 116 may include a central aperture 117 through which the elastic member 108 passes. The elastic member 108 may have a relatively small diameter. For example, the elastic member 108 may have diameter between ⅛ and ½ inch. If a user were to directly grip the elastic member during a workout, then such small diameters may cause discomfort or fatigue to a user during even relatively short workouts. The handle 116 has a diameter that is greater than the diameter of the elastic member 108. The handle 116 provides additional padding between the elastic member 108 and the user's hand and increases the gripping surface area for the user. The increased surface area distributes the forces associated with using the elastic fitness device 100 over a greater area and can reduce discomfort and fatigue in a user's hands. The handle 116 can have various lengths and can be longer or shorter than as illustrated in FIG. 1. In some implementations, the handle 116 can be curved, rather than straight as illustrated in FIG. 1, such as to match a curvature of the handle member 109*b*.

The elastic fitness device 100 also includes a handle 106 on each rod 102. The handles 106 may be padded such that they provide a more comfortable and higher friction gripping surface as compared to the rods 102, which may have a smooth or bare exterior surface. The handles 106 are positionable along the length of each respective rod 102 such that they may be positioned at one or more locations between the end of a respective rod 102 and the coupling 103 that couples each rod 102 to the central handle 104.

The handles 106 include a lock 107 that fixes the handle to the rod 102 at a particular or desired location. For example, during some exercises a user may be directed to space the handles 106 far apart in order to exercise a certain set of muscles, while during other exercises the handles 106 may be placed closer together in order to exercise a different set of muscles.

The handles 106 shown in FIG. 1 include an integral resistance adjuster 112. The resistance adjuster 112 is used to adjust the resistance provided by the elastic member 108. For example, when the resistance adjusters 112 are placed far apart, as shown in FIG. 1, the elastic member 108 provides relatively low resistance. When the resistance adjusters 112 are placed closer together the elastic member 108 provides a relatively high resistance.

The difference in resistance provided by the same elastic member 108 is caused by the change in the path length along the elastic member 108 for a given amount of pull. For example when the resistance adjusters 112 are at a position at, or very near, the central handle 104, when a user pulls the handle 116 a distance of twelve inches from a rest position, then the elastic member stretches approximately 24 inches.

For a similar 36 inch elastic fitness device, when the elastic member is affixed at the ends of the rods 102, but not routed through the resistance adjusters 112, then pulling the handle 116 twelve inches from a rest position only stretches the elastic member approximately 21½ inches.

The handles 106 also include a channel 114. The elastic member 108 may be routed through some or all of the channel 114. For example, as shown in FIG. 1, a portion of the elastic member passes through the channel 114. The depth of the channel may be the same as or greater than the diameter of the elastic member 108. In some embodiments, the depth of the channel 114 may be less than the diameter of the elastic member 108.

Figure 2:
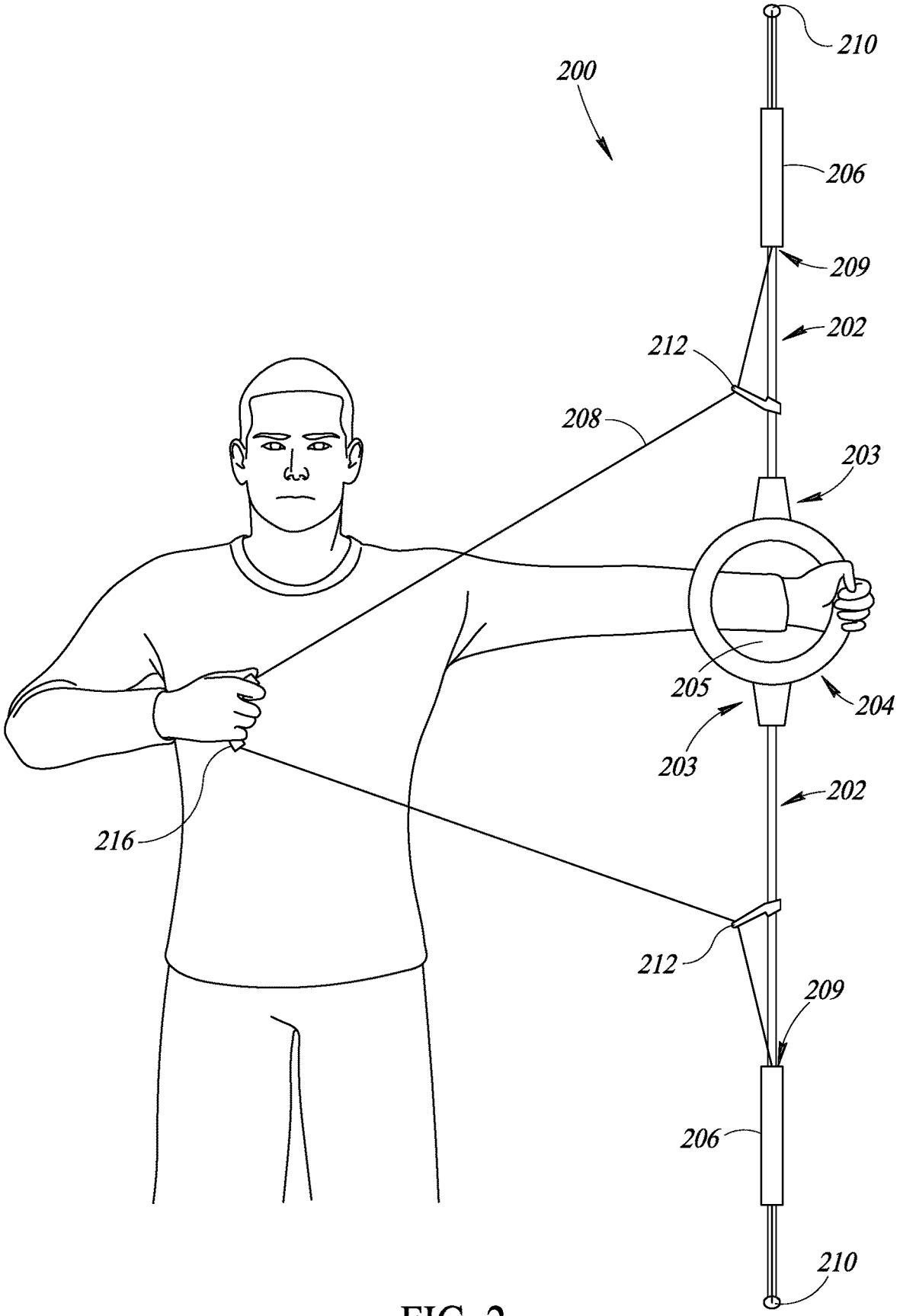
FIG. 2 depicts a person using an elastic resistance device according to one or more embodiments disclosed herein.

FIG. 2 shows a user exercising with an elastic fitness device 200. The elastic fitness device 200 is similar to the elastic fitness device 100 in that it includes two rods 202 that extend from, and are coupled to, a central handle 204 and an elastic member 208 that is coupled via a respective coupling 210 to respective ends of each rod 202. The rods 202 are coupled to the central handle 204 via couplings 203.

Each end of the elastic member 208 is coupled to a respective end of the rods 202 of the elastic fitness device 200. The elastic fitness device 200 also includes a handle 216 on the elastic member 208.

The elastic fitness device 200 also includes a handle 206 on each rod 202. The handles 206 are positionable along the length of each respective rod 202 such that they may be positioned at one or more locations between the end of a respective rod 202 and a coupling 203 that couples each rod 202 to the central handle 204. Unlike the handles 106 of FIG. 1, which include a lock 107 and a resistance adjuster 112, the handles 206 shown in FIG. 2 include neither of these features. Although the handles 206 are positionable along the length of the respective rods 202, the handles 206 are held in place by friction between each handle 206 and its respective rod 202.

In addition, resistance adjusters 212 are not integral with the handles, instead they are separately positionable along the length of the rods 202. As with the resistance adjuster 112 of the embodiment shown in FIG. 1, the resistance adjuster 212 shown in FIG. 2 is used to adjust the resistance provided by the elastic member 208.

The handles 206 also include a central aperture 209 through which the elastic member 208 is routed. In some embodiments, the handles 206 may include a channel in the internal surface of the central aperture 209 of the handle 206.

The user in FIG. 2 is demonstrating one possible exercise for which an elastic fitness device 200 may be used. In this example, the user grips the central handle 204 with the left hand and the handle 216 with the right hand and pulls the handle 216, stretching the elastic member 208.

Figure 3:
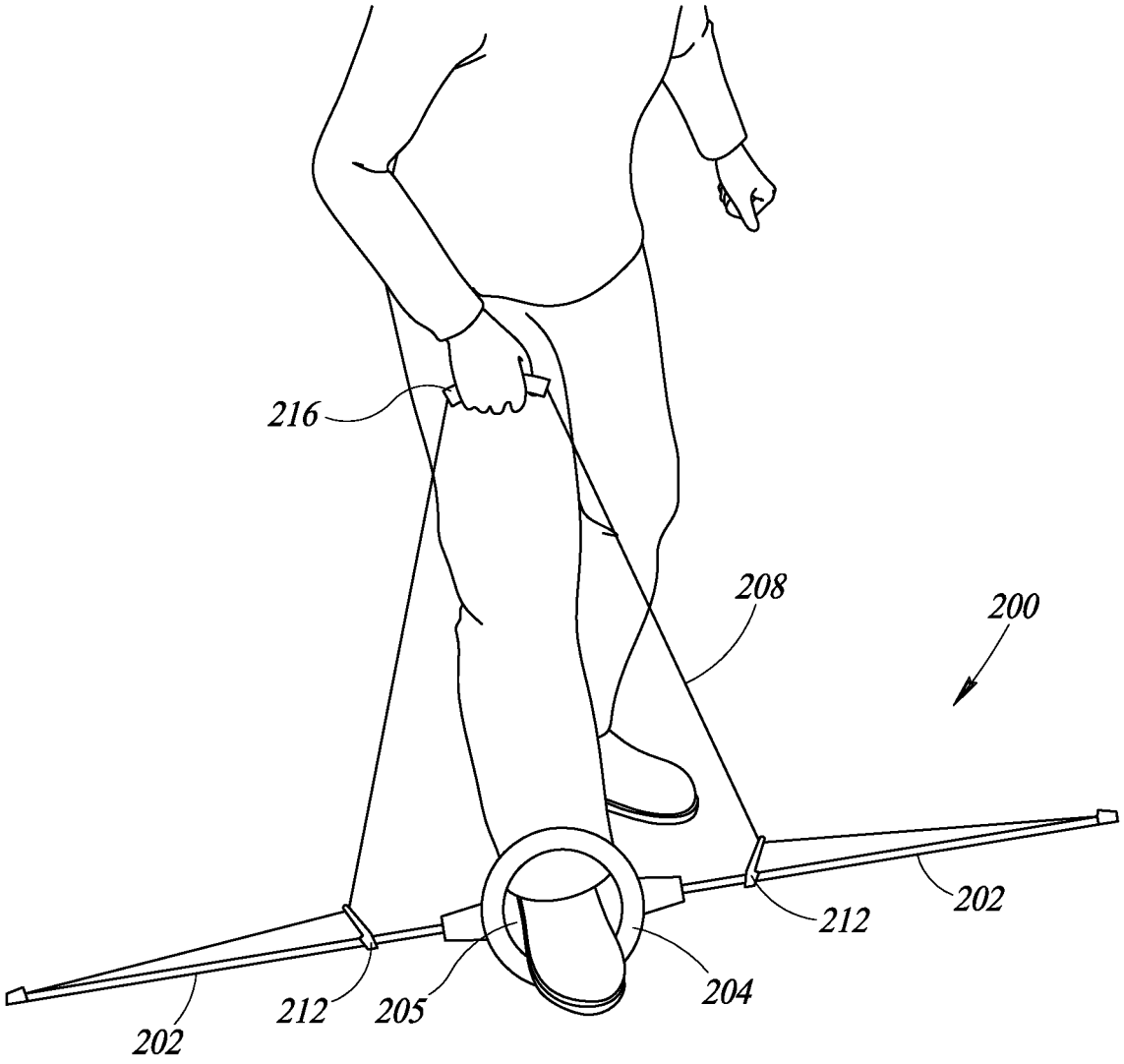
FIG. 3 depicts an alternate use of the elastic resistance device of FIG. 2 according to one or more embodiments disclosed herein.

FIG. 3 shows a user demonstrating another possible exercise for which an elastic fitness device 200 may be used. In this example, the user holds the elastic fitness device 200 against the floor by placing a foot through an aperture 205 of the handle 204 and stepping on the body of the central handle 204. The user can then pull up on the handle 216 and elastic member 208 with one or both hands.

FIG. 3 also shows the elastic fitness device 200 with the resistance adjusters 212 in a position near the central handle 204, providing increased resistance. As is also shown in FIG. 3, the handles 206 may be removable from the rods 202.

Figure 4:
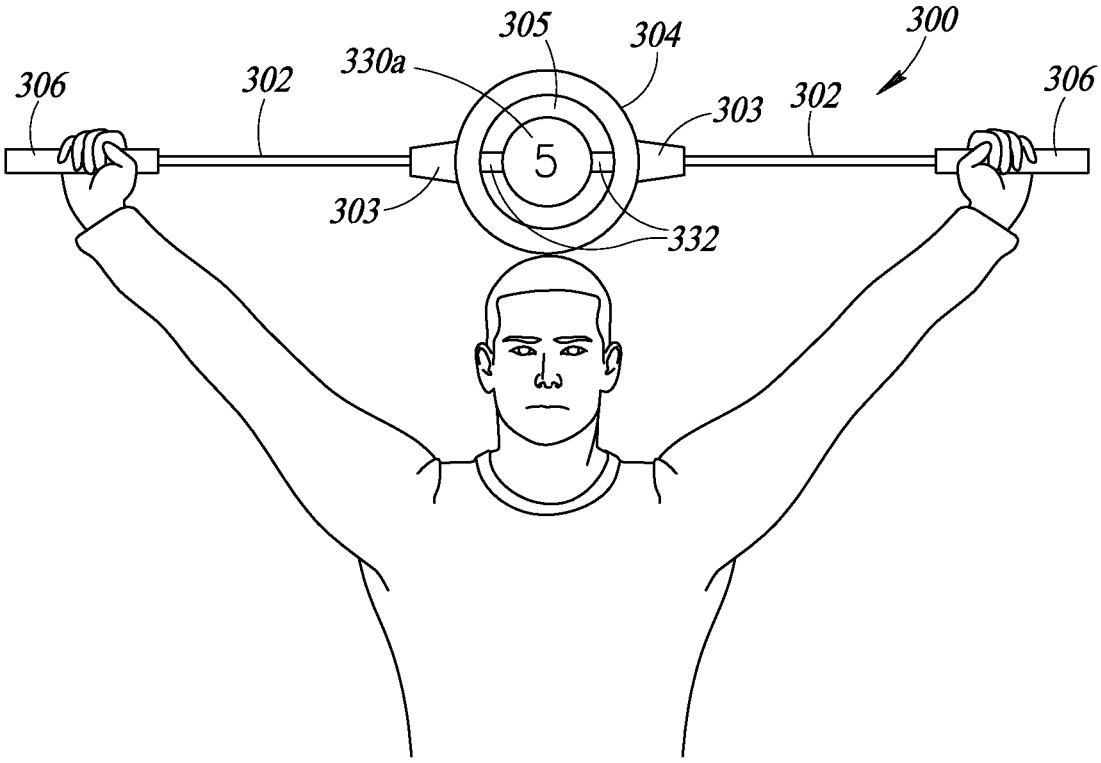
FIG. 4 depicts a person using an elastic resistance device according to one or more embodiments disclosed herein.

FIG. 4 shows an embodiment of an elastic fitness device 300. The elastic fitness device 300 is similar to the elastic fitness device 100 of FIG. 1 in that it includes two rods 302 that extend from, and are coupled to, a central handle 304. The elastic fitness device 300 may include an elastic member that can be coupled the respective ends of each rod 302, but as depicted in FIG. 3, the elastic member is removed so that the user may use the elastic fitness device as a barbell.

The elastic fitness device 300 also includes a handle 306 on each rod 302. The handles 306 are positionable along the length of each respective rod 302 such that they may be positioned at one or more locations between the end of a respective rod 302 and a respective coupling 303 that couples each rod 302 to the central handle 304. Unlike the handles 106 of the embodiment of FIG. 1, which include a lock 107 and a resistance adjuster 112, the handles 306 of FIG. 4 include neither of these features. Although the handles 306 are positionable along the length of the respective rods 302, the handles 306 are held in place by friction between each handle 306 and its respective rod 302, similar to the handles 206 described above with respect to the example embodiment shown in FIG. 2.

In addition, the elastic fitness device 300 has also had its resistance adjusters removed.

The elastic fitness device 300 includes an interchangeable weight such as a five-pound interchangeable weight 330*a*. The interchangeable weight 330*a* is coupled to the elastic fitness device 300 within a central aperture 305 of the central handle 304. The elastic fitness device 300 includes couplings 332 that couple the interchangeable weight to elastic fitness device 300. The couplings 332 may be integral with, or affixed to, the interchangeable weight 330*a*. In some embodiments, the couplings may be affixed to, or integral with, the central handle 304.

Figure 5:
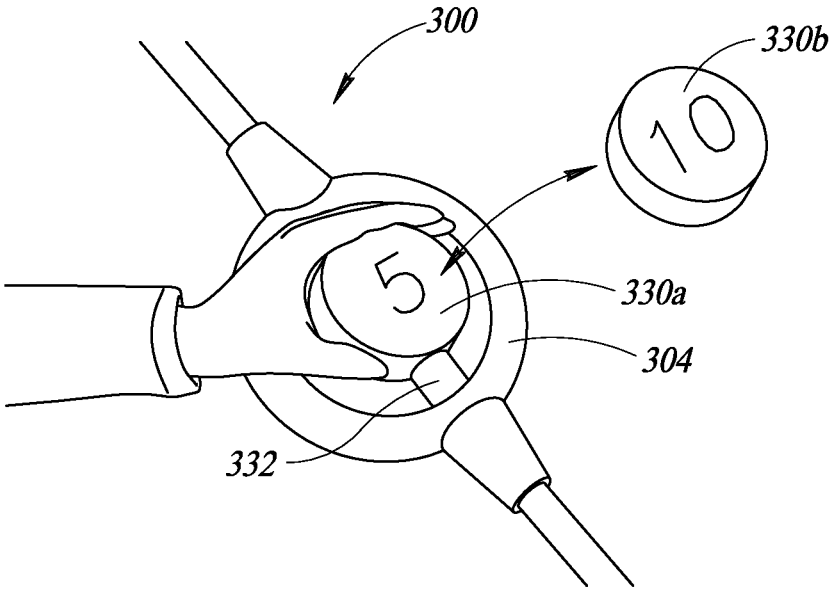
FIG. 5 depicts the interchangeable weights of the elastic resistance device of FIG. 4 according to one or more embodiments disclosed herein.

FIG. 5 shows an embodiment of the five-pound interchangeable weight 330*a* being swapped for a ten-pound interchangeable weight 330*b*. Although only five and ten pound weights are shown, other weights may be used with the elastic fitness device 300.

Figure 6:
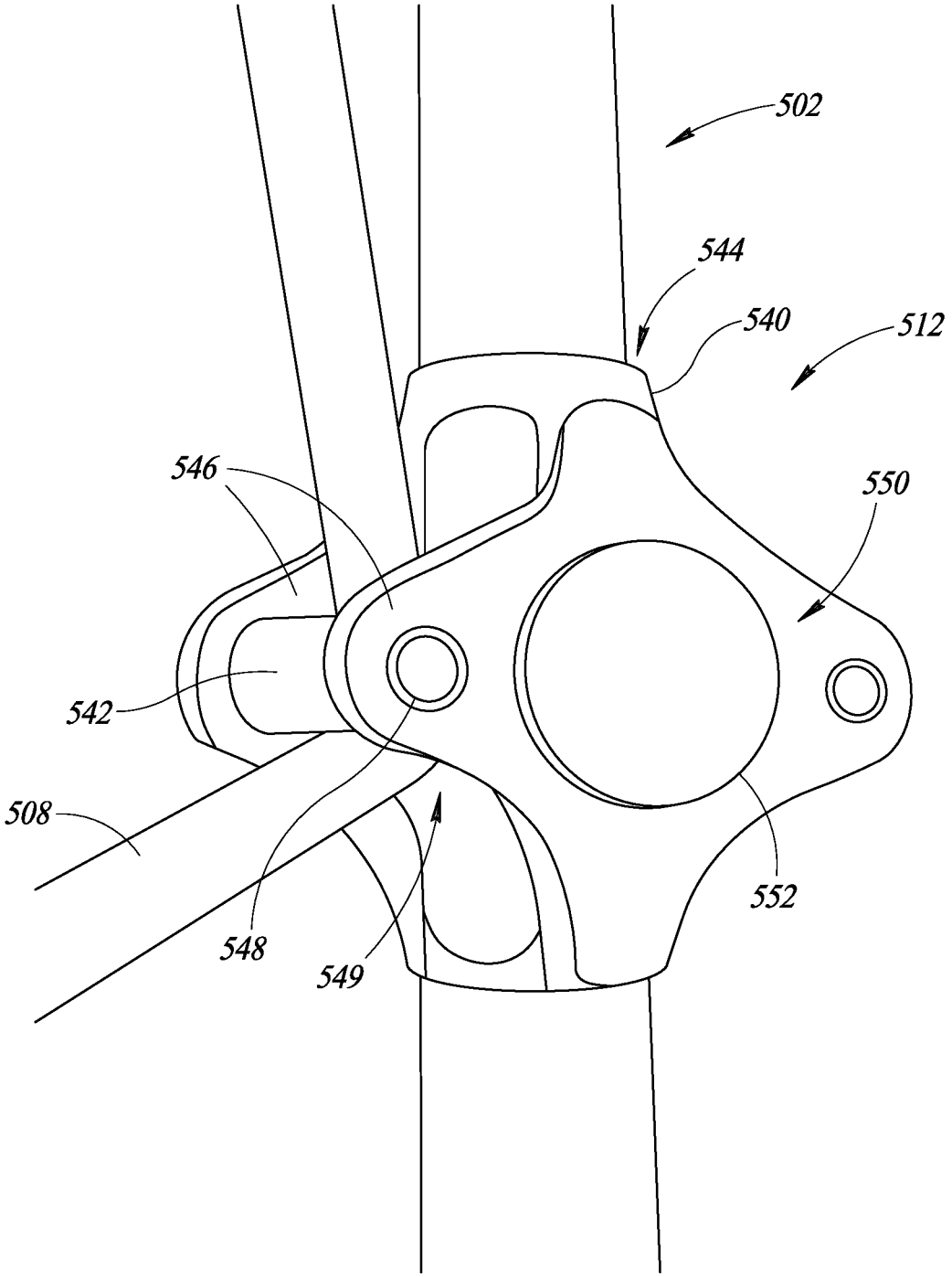
FIG. 6 depicts a resistance adjuster according to one or more embodiments disclosed herein.

FIG. 6 shows an embodiment of a resistance adjuster 512 mounted on a rod 502. The resistance adjuster 512 includes a body 540 including an aperture 544, through which the rod 502 passes. The body 540 of the resistance adjuster 512 slides along the length of the rod 502 and is held in place by a clamp mechanism 550 that, when engaged, holds the resistance adjuster 512 in place on the rod 502 by applying a clamping force to the rod 502. The clamping mechanism includes a push button 552 that when depressed releases the clamping force on the rod 502 and allows the resistance adjuster 512 to slide along the rod 502.

The resistance adjuster 512 also includes a pulley 542 mounted between two extensions 546 on, for example, a shaft 548. The pulley 542, along with the body 540 and the extensions 546, forms an aperture 549 through which an elastic member 508 passes. The pulley 542 acts to reduce the sliding resistance of the elastic member 508 as it moves through the aperture 549.

Figure 7:
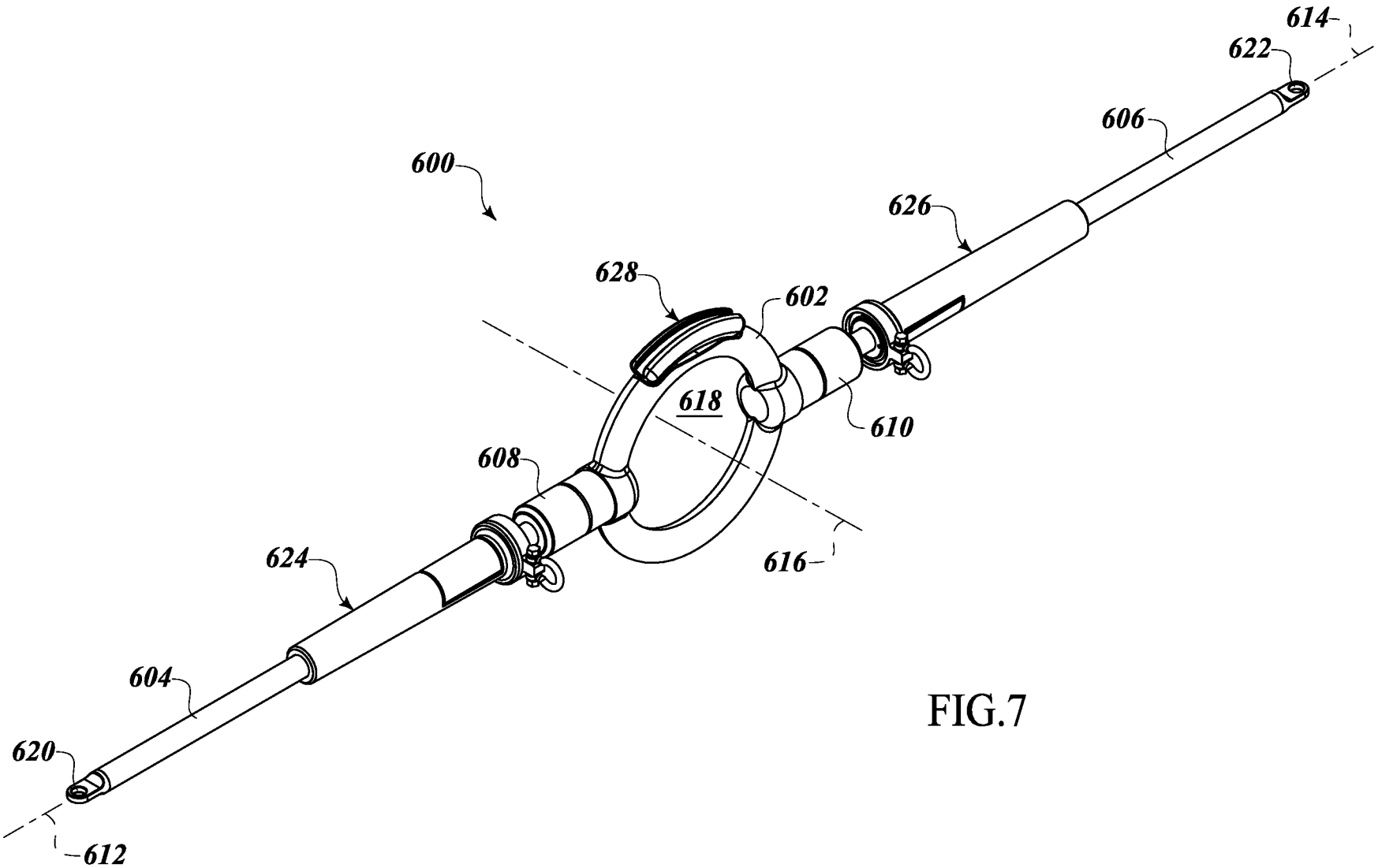
FIG. 7 depicts a modular elastic resistance device according to one or more embodiments disclosed herein.

FIG. 7 illustrates a modular elastic fitness device 600 that is similar to the elastic fitness devices 100, 200, and 300, and that can include any of the features described above for the elastic fitness devices 100, 200, and 300. The elastic fitness device 600 includes a central, ring-shaped handle 602, a first rod 604 coupled to the handle 602, and a second rod 606 coupled to the handle 602. The first rod 604 is removably coupled to the handle 602 at a first coupling 608, which can be a collet-based coupling, and extends radially away from the handle 602 in a first direction. The second rod 606 is removably coupled to the handle 602 at a second coupling 610 located opposite to the first coupling 608 across a diameter of the handle 602, which can be a collet-based coupling, and extends radially away from the handle 602 in a second direction opposite to the first direction.

The first rod 604 and the first coupling 608 have a common first central longitudinal axis 612 and the second rod 606 and the second coupling 610 have a common second central longitudinal axis 614 that is coincident with the first central longitudinal axis 612. The handle 602 forms a ring having an aperture 618 at its center, with a central longitudinal axis 616 of the ring and its aperture 618 extending perpendicularly to the first and second central longitudinal axes 612, 614 of the first and second rods 604, 606. The handle 602 and its aperture 618 are sized so that a user can grasp the handle 602 by putting their fingers, a hand, or an arm through its aperture 618.

As used herein, the terms "proximal" and "distal" refer to relative locations wherein "proximal" refers to a location nearer to a center of the elastic fitness device 600 along the first and second central longitudinal axes 612 and 614, and "distal" refers to a location farther from the center of the elastic fitness device 600 along the axes 612 and 614. For example, the first rod 604 is coupled at its proximal end to the handle 602 at the first coupling 608 and the second rod 606 is coupled at its proximal end to the handle 602 at the second coupling 610.

The first rod 604 includes a coupling such as a ring, eyelet, or aperture 620 at its distal end, to which a first end of an elastic member can be coupled. The second rod 606 includes a coupling such as a ring, eyelet, or aperture 622 at its distal end, to which a second end of the elastic member can be coupled. The first rod 604 can have a first adjustable handle 624 mounted thereon, the second rod 606 can have a second adjustable handle 626 mounted thereon, and the handle 602 can have an elastic member handle 628 mounted thereon. The first and second couplings 608, 610 can be structurally identical to one another, the first and second rods 604, 606 can be structurally identical to one another, and the first and second adjustable handles 624, 626 can be structurally identical to one another.

Figure 8:
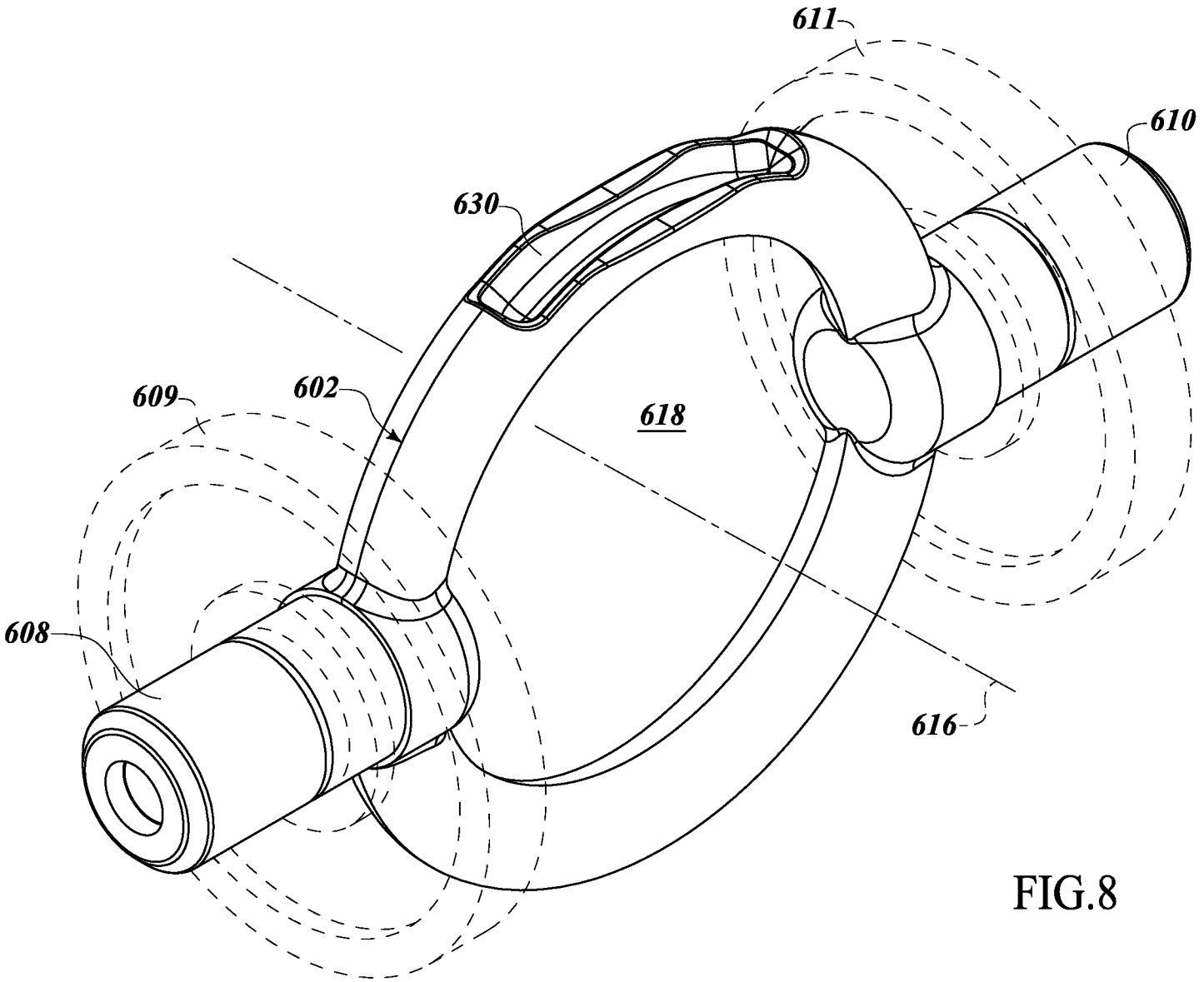
FIG. 8 depicts a portion of the elastic resistance device of FIG. 7, wherein the elastic resistance device is in a kettlebell configuration, according to one or more embodiments disclosed herein.

FIG. 8 illustrates that the device 600 can be disassembled to leave the central handle 602 and the first and second couplings 608 and 610, which can be referred to as a "kettlebell" configuration. The first and second couplings 608 and 610 can have dimensions matching standard barbell ends or Olympic barbell sleeves, so that standard-sized or Olympic-sized plate weights 609 and 611 can be loaded onto the first and second couplings 608, 610 so that a user can use the device 600 in the kettlebell configuration as though it were a kettlebell or a dumbbell. For example, the first and second couplings 608 and 610 can have cylindrical outer surfaces with outer diameters of about 4.95 cm or about 5.00 cm to replicate the ends or sleeves of an Olympic bar.

Figure 9:
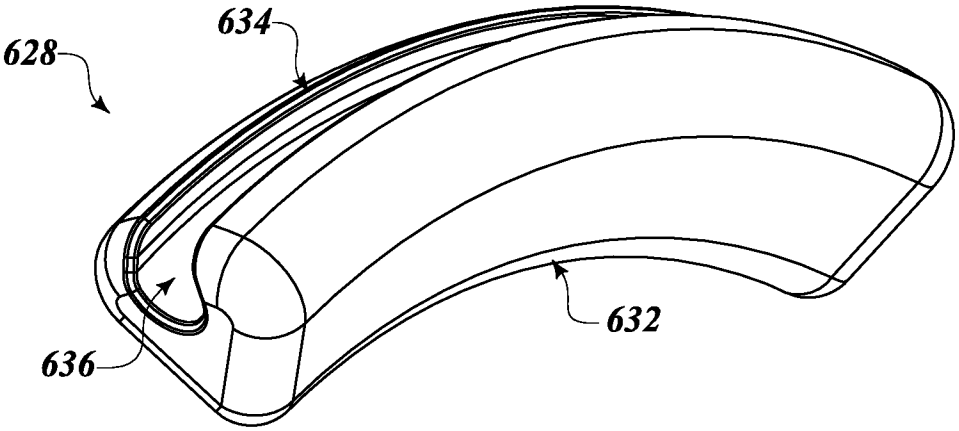
FIG. 9 depicts an elastic member handle of the elastic resistance device of FIG. 7, according to one or more embodiments disclosed herein.

FIG. 8 also illustrates that an outer surface of the handle 602 includes an indentation or a recess 630, which can be sized and dimensioned to receive or cradle the elastic member handle 628. FIG. 9 illustrates the elastic member handle 628 at a larger scale. As illustrated in FIG. 9, the elastic member handle 628 has a curved or arcuate shape with a radius of curvature matching the radius of curvature of the handle 602, so that an inner surface 632 of the elastic member handle 628 (i.e., with respect to the curvature of the elastic member handle 628), can be received or cradled within the recess 630. FIG. 9 also illustrates that an outer surface 634 of the elastic member handle 628 (i.e., with respect to the curvature of the elastic member handle 628) includes a slot or groove 636 sized to receive an elastic member (see, e.g., reference numeral 108 in FIG. 1).

Figure 10:
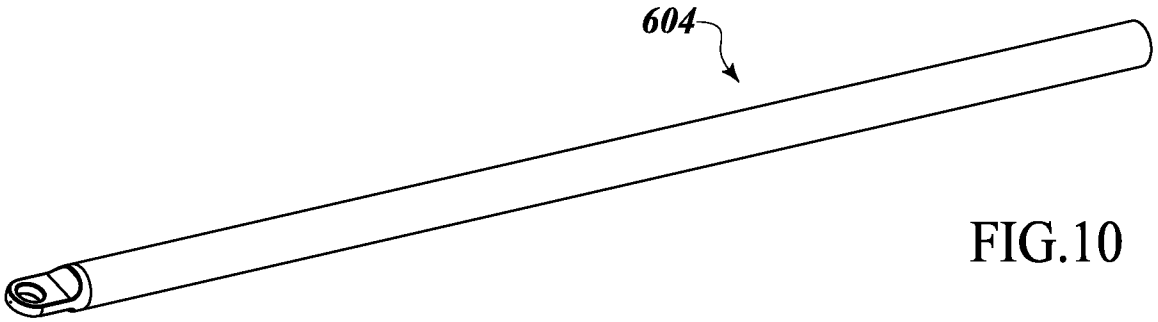
FIG. 10 depicts a rod of the elastic resistance device of FIG. 7, according to one or more embodiments disclosed herein.
Figure 11:
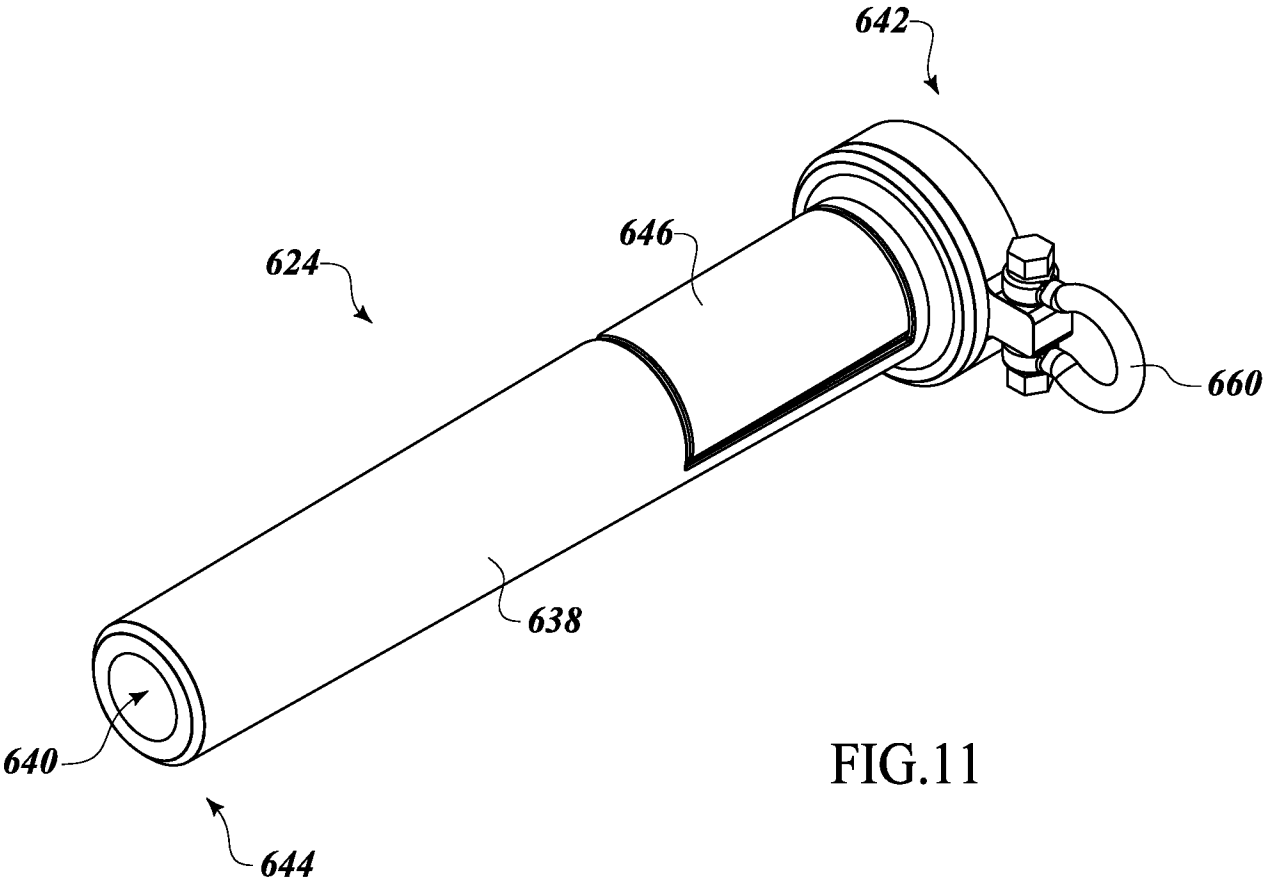
FIG. 11 depicts an adjustable handle of the elastic resistance device of FIG. 7, according to one or more embodiments disclosed herein.

FIG. 10 illustrates the first rod 604 separated from the rest of the device 600 and at a larger scale. FIG. 11 illustrates the first handle 624 separated from the rest of the device 600 and at a larger scale. As illustrated in FIG. 11, the handle 624 includes a cylindrical hollow body 638 that has a cylindrical conduit 640 extending from a proximal end 642 of the handle 624 to a distal end 644 of the handle 624. The cylindrical conduit 640 is dimensioned so that the first rod 604 can extend therethrough and fit smoothly therein. The handle 624 also includes a shackle 660 coupled to the proximal end 642 of the handle 624. The shackle 660 is dimensioned so that an elastic member can pass through its opening. In some embodiments, a pulley or sheave can be coupled to the shackle 660 and the elastic member can pass through the shackle 660 and over the pulley or sheave, to reduce friction between the elastic member and the rest of the device 600 as the elastic member passes through the shackle 660. The handle 624 also includes a lever or clip 646 coupled to the cylindrical hollow body 638.

Figure 12:
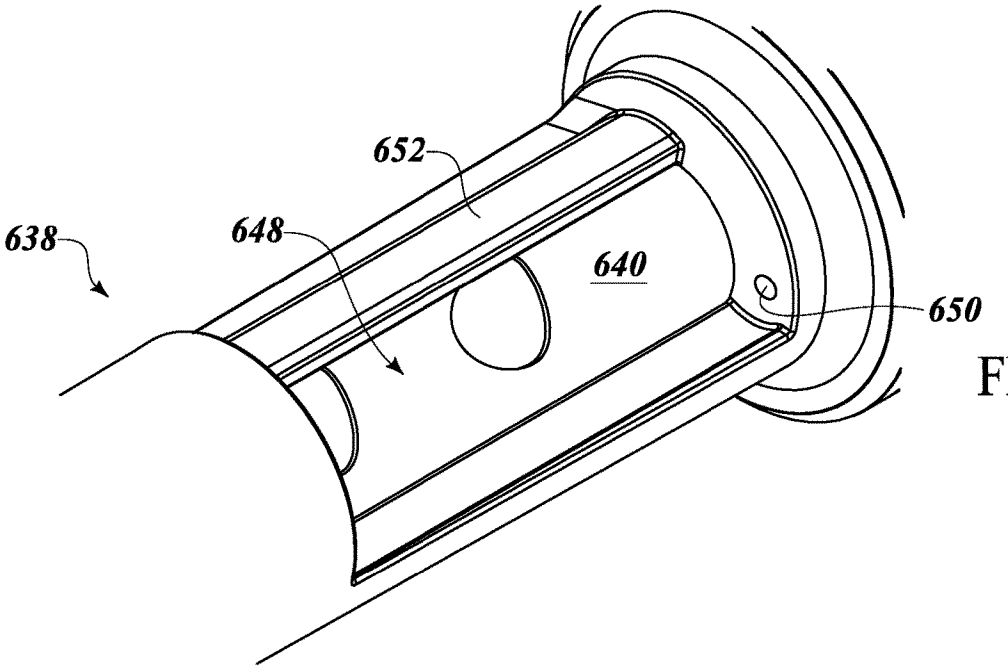
FIG. 12 depicts a larger view of a portion of the adjustable handle depicted in FIG. 11, according to one or more embodiments disclosed herein.

FIG. 12 illustrates a portion of the cylindrical hollow body 638 with the clip 646 removed and at a larger scale. As illustrated in FIG. 12, the cylindrical hollow body 638 can have an opening 648 in its side wall at a location adjacent to the shackle 660 and near the proximal end 642 of the handle 624. The opening 648 can extend partially around the circumference of the handle 624, such as between 90 degrees and 180 degrees around the circumference of the handle 624. A first circumferential end of the opening 648 can include bearings 650 for rotatably mounting the clip 646 to the cylindrical hollow body 638. A second circumferential end of the opening 648 opposite to the first circumferential end can include a partial wall 652 that extends from an inner surface of the hollow body 638 partially outward through the thickness of the hollow body 638. The partial wall 652 allows the clip 646 to rotate partially into the opening 648 and halts rotation of the clip 646 into the opening 648, to leave the handle 624 with a flush outer surface when the clip 646 is rotatable to abut against the partial wall 652.

Figure 13:
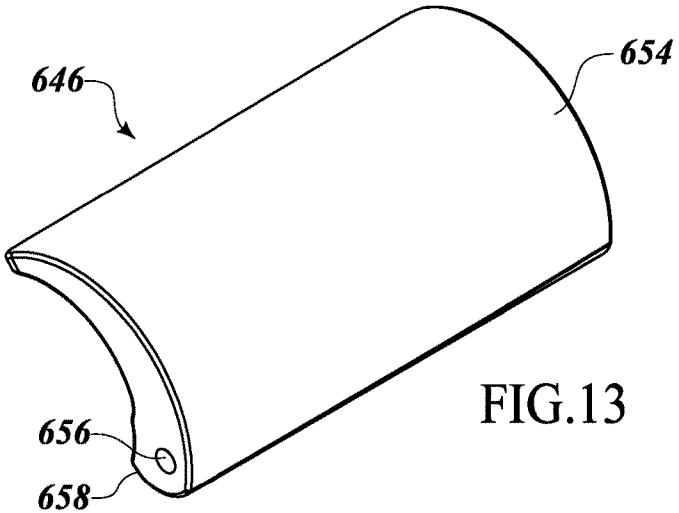
FIG. 13 depicts a larger view of a portion of the adjustable handle depicted in FIG. 11, according to one or more embodiments disclosed herein.

FIG. 13 illustrates the clip 646 separated from the rest of the device 600 and at a larger scale. As illustrated in FIG. 13, the clip 646 can have an arcuate or curved shape with an outer surface 654 curved to match a curvature of the outer surface of the cylindrical hollow body 638. A first circumferential end of the clip 646 includes bearings 656 that can be coupled to the bearings 650 to allow the clip 646 to rotate with respect to the cylindrical hollow body 638. An outer profile 658 of the first end of the clip 646 can form a cam so that as the clip 646 is rotated with respect to the cylindrical hollow body 638, the clip 646 engages with the first rod 604 when it is positioned within the conduit 640 to lock the first handle 624 in position with respect to the first rod 604. Thus, the clip 646 can be rotated away from the opening 648 to allow a user to adjust the position of the first handle 624 along the length of the first rod 604, and can be rotated into the opening 648 to allow the user to lock the first handle 624 to the first rod 604.

Although an elastic member is not illustrated in FIGS. 7 through 13, an elastic member such as one of the elastic members 108 and 208 can be coupled to the other components of the device 600 described herein. For example, a first end of an elastic member can be coupled to the aperture 620, a second end of the elastic member opposite to its first end can be coupled to the aperture 622, and the elastic member can extend from its first end, through the shackle 660, through the groove 636 of the elastic member handle 628, through a shackle of the second handle 626, and to its second end.

A method of using the device 600 can include adjusting the positions of the first and second adjustable handles 624 and 626 along the lengths of the first and second rods 604, 606, respectively, to adjust the resistance of the elastic member extending through the shackles 660 of the adjustable handles 624 and 626. A user can then grasp the ring-shaped handle 602 of the device 600 with a first hand, grasp the elastic member handle 628 and the elastic member with a second hand, and pull the elastic member handle 628 away from the ring-shaped handle 602, against the resistance of the elastic member, to exercise.

The user can then halt this form of exercise and remove the first and second rods 604 and 606, the first and second handles 624 and 626, and the elastic member from the ring-shaped handle 602 and the first and second couplings 608 and 610. The user can then position standard or Olympic plate weights on the exterior surfaces of the couplings 608 and 610, and use standard or Olympic clips or collars, such as lock-jaw type or spring-based collars, to secure the plate weights on the couplings 608 and 610. The user can then grasp the ring-shaped handle 602 with a first hand and lift the ring-shaped handle 602, couplings 608 and 610, plate weights, and locking collars, to exercise.

The user can then halt this form of exercise and remove the locking collars and the plate weights from the couplings 608 and 610. The user can then couple the first and second rods 604 and 606, the first and second handles 624 and 626, and the elastic member, to the ring-shaped handle 602 and the first and second couplings 608 and 610. The user can then grasp the ring-shaped handle 602 of the device 600 with a first hand, grasp the elastic member handle 628 and the elastic member with a second hand, and pull the elastic member handle 628 away from the ring-shaped handle 602, against the resistance of the elastic member, to exercise.

FIGS. 14, 18, 20, and 24 illustrate perspective, side, end, and front views of a modular fitness system 700 that is similar to the fitness devices 100, 200, 300, and 600. The modular fitness system 700 can include any of the features described above for the fitness devices 100, 200, 300, and 600. The fitness system 700 includes a central, ring-shaped handle 702, a first end cap 704, a first inner cap 724, a first washer plate 726, and a first nut or collar 728 coupled to the handle 702, as well as a second end cap 706, a second inner cap 730, a second washer plate 732, and a second nut or collar 734 coupled to the handle 702.

Figure 16:
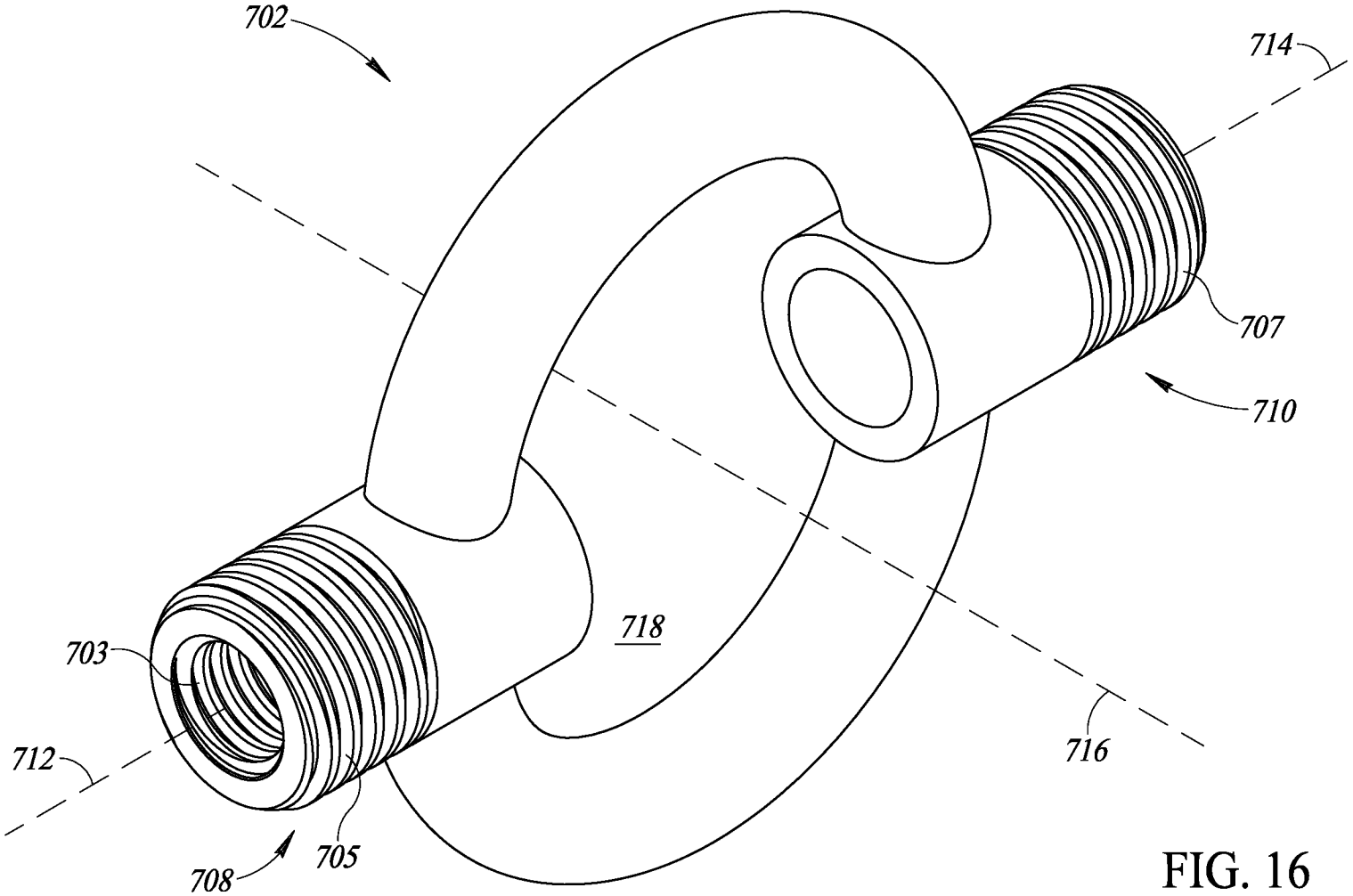
FIG. 16 depicts a perspective view of a handle portion of the exercise system of FIG. 14, according to one or more embodiments disclosed herein.
Figure 17:
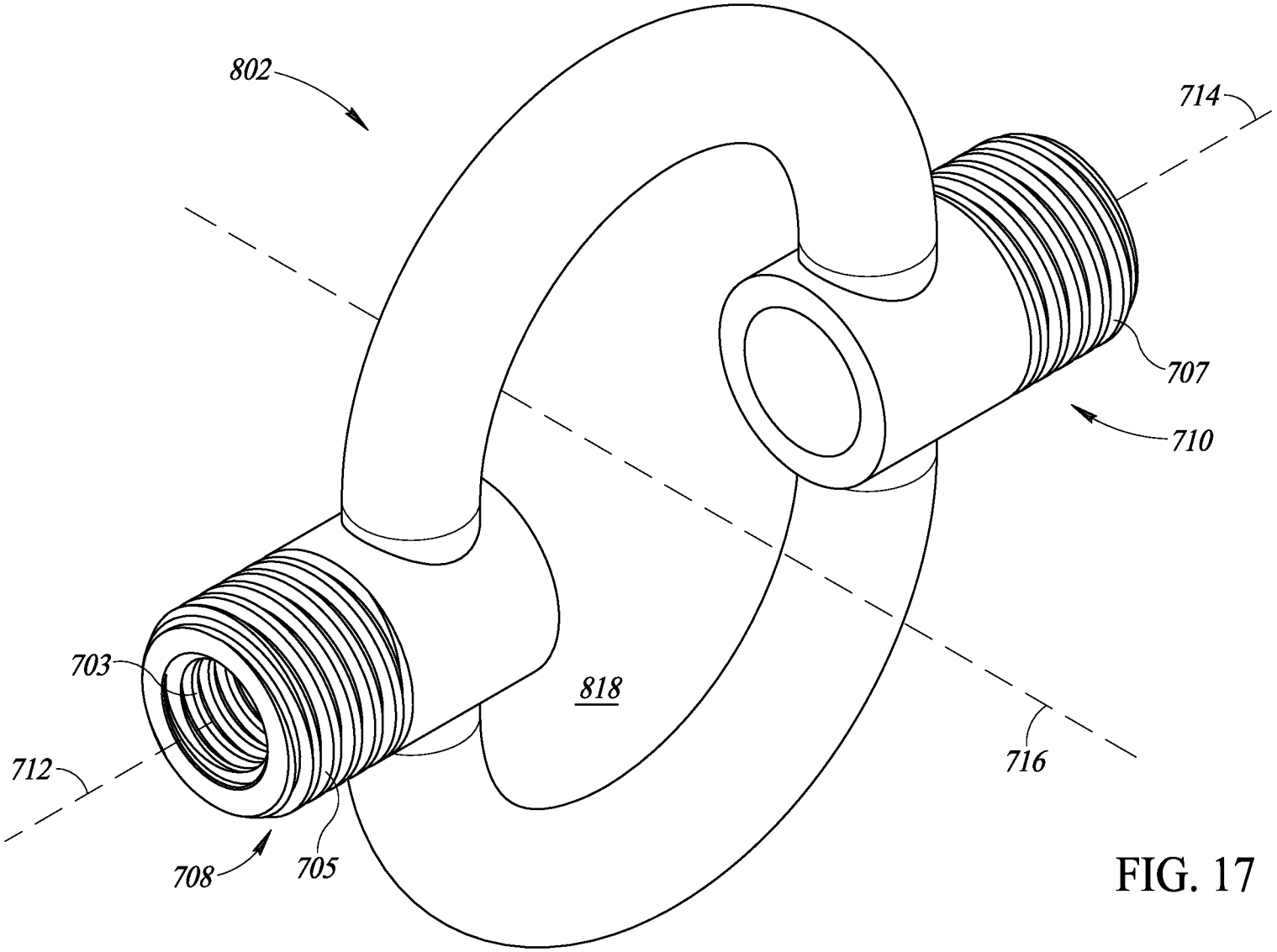
FIG. 17 depicts a perspective view of a handle portion of the exercise system of FIG. 15, according to one or more embodiments disclosed herein.
Figure 18:
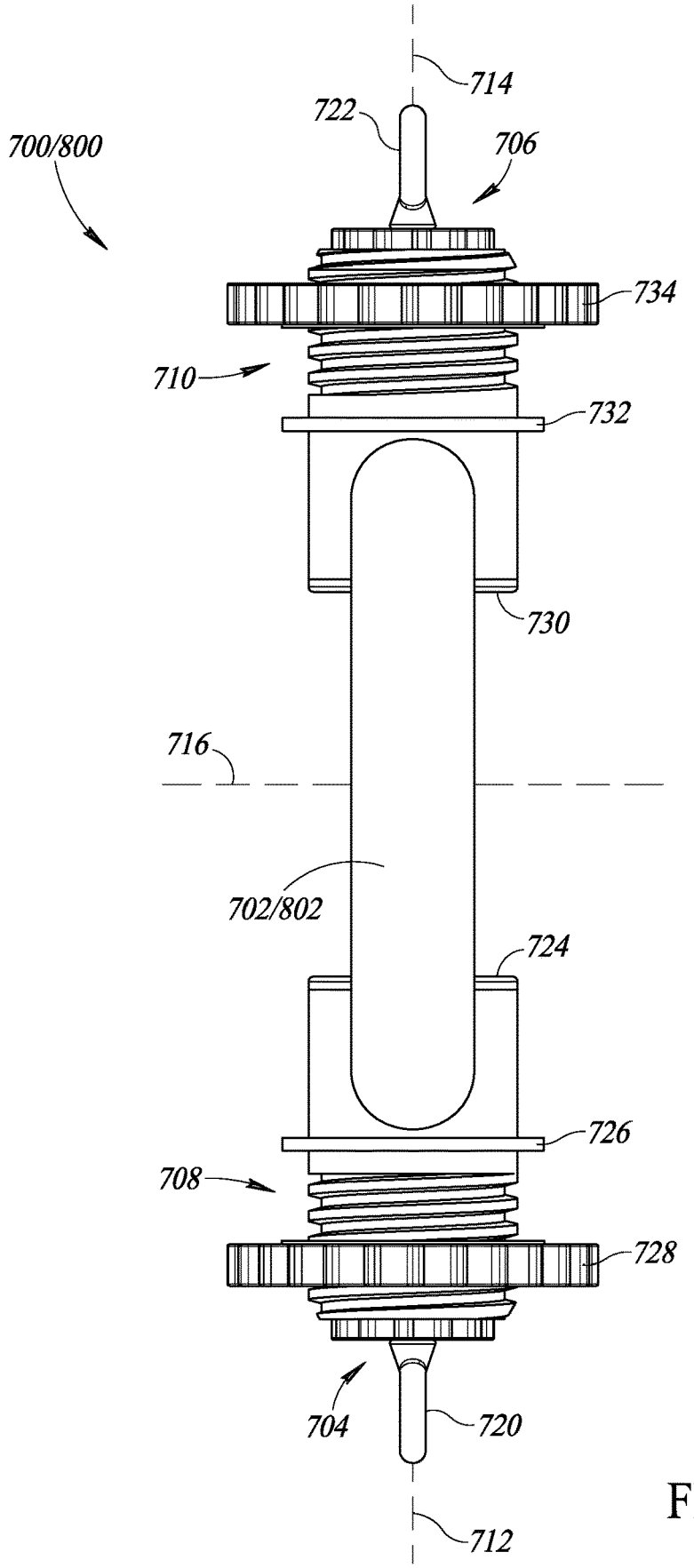
FIG. 18 depicts a side view of the exercise system of FIG. 14, which is identical to a side view of the exercise system of FIG. 15, according to one or more embodiments disclosed herein.
Figure 19:
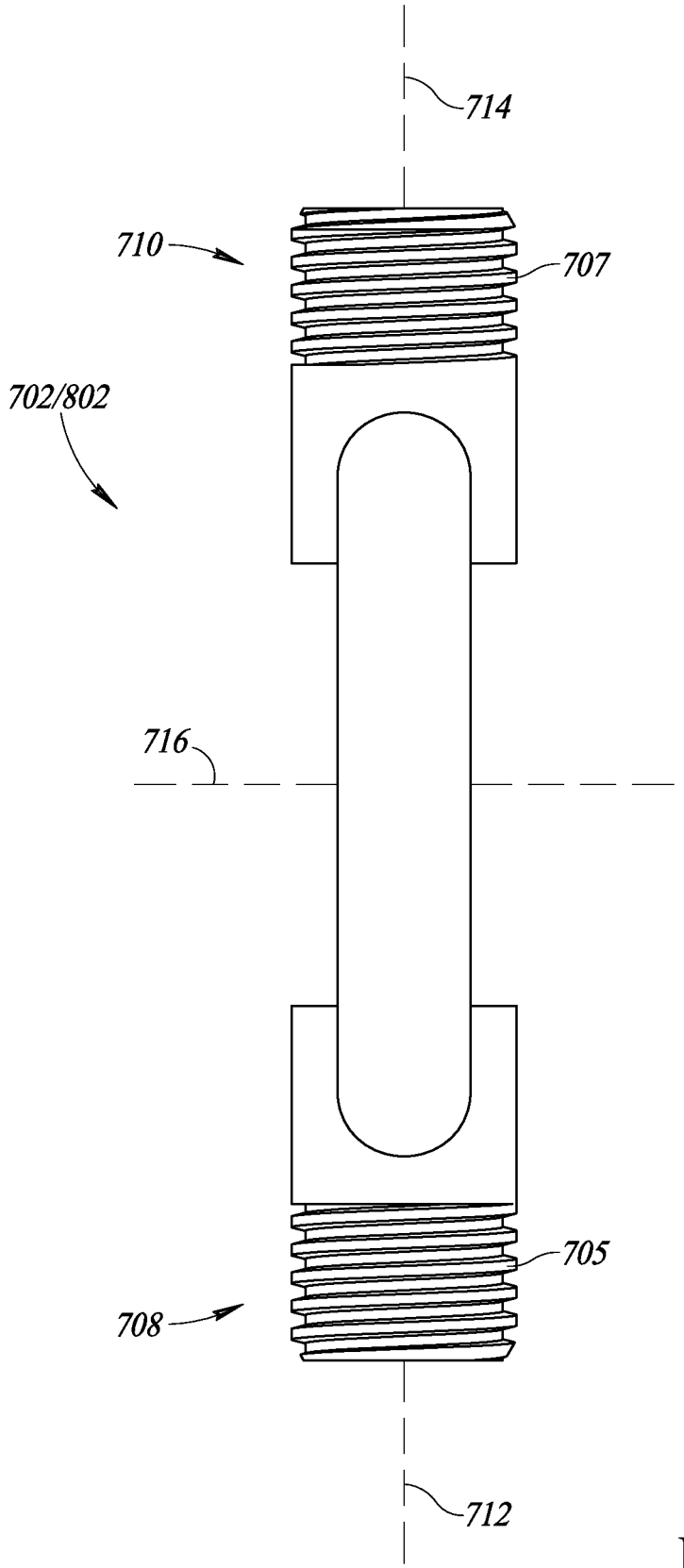
FIG. 19 depicts a side view of the handle portion of the exercise system of FIG. 14, which is identical to a side view of the handle portion of the exercise system of FIG. 15, according to one or more embodiments disclosed herein.
Figure 21:
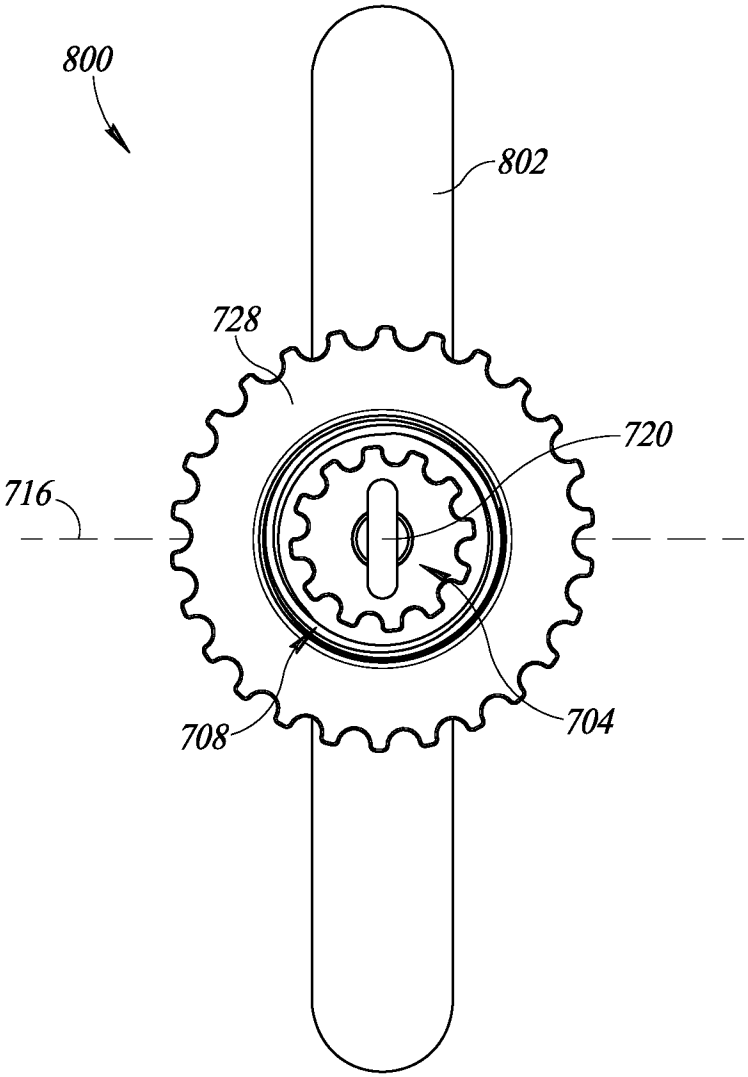
FIG. 21 depicts an end view of the exercise system of FIG. 15, according to one or more embodiments disclosed herein.
Figure 20:
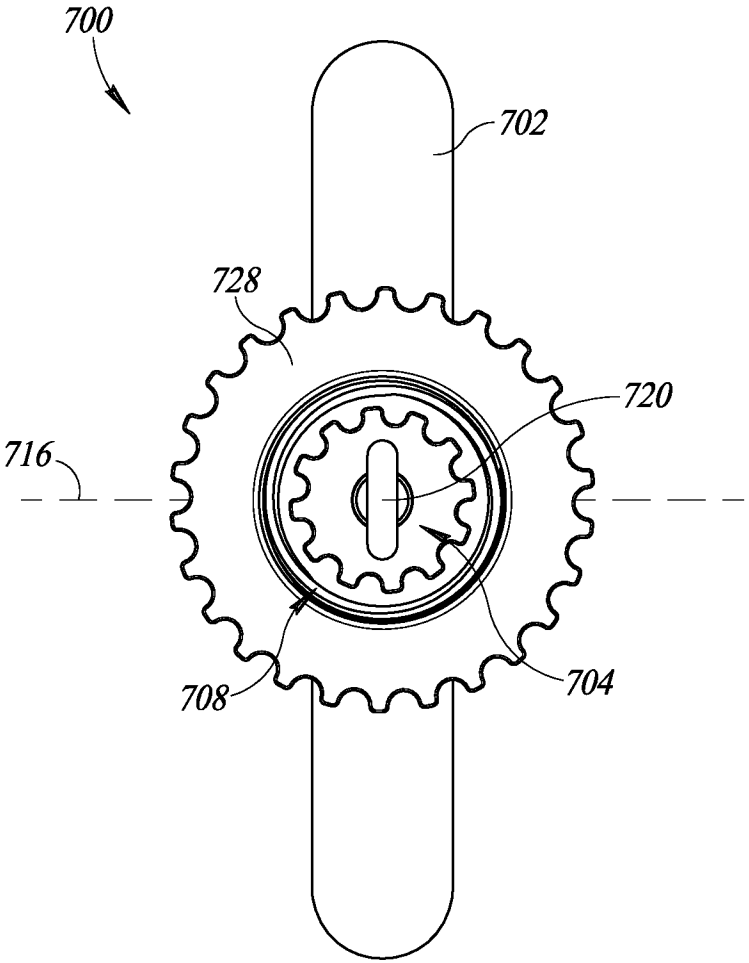
FIG. 20 depicts an end view of the exercise system of FIG. 14, according to one or more embodiments disclosed herein.
Figure 23:
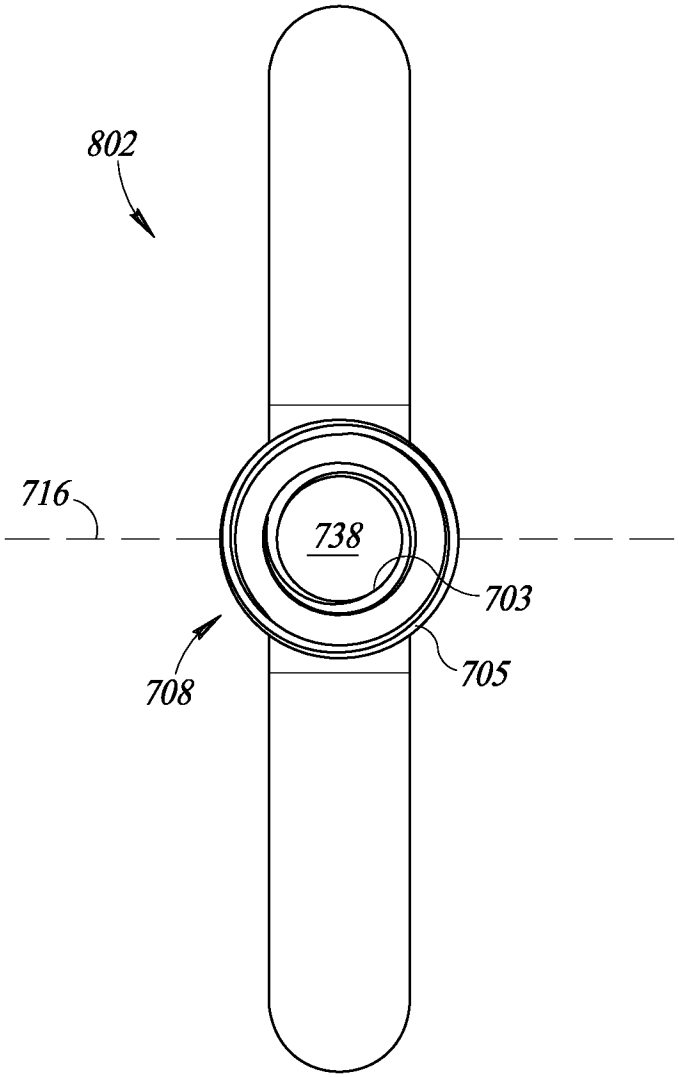
FIG. 23 depicts an end view of the handle portion of the exercise system of FIG. 15, according to one or more embodiments disclosed herein.
Figure 22:
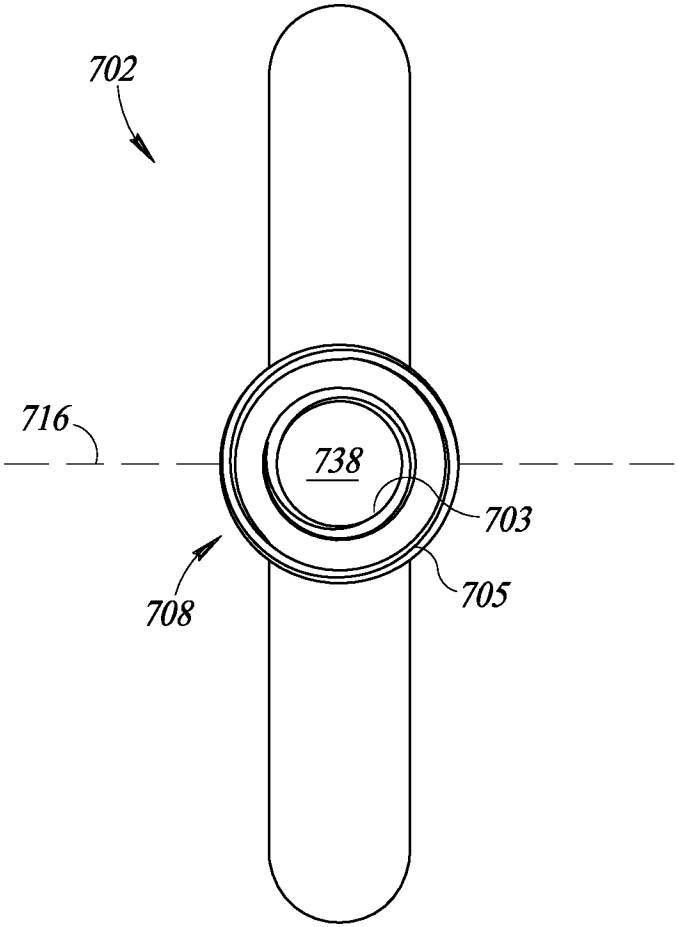
FIG. 22 depicts an end view of the handle portion of the exercise system of FIG. 14, according to one or more embodiments disclosed herein.
Figure 24:
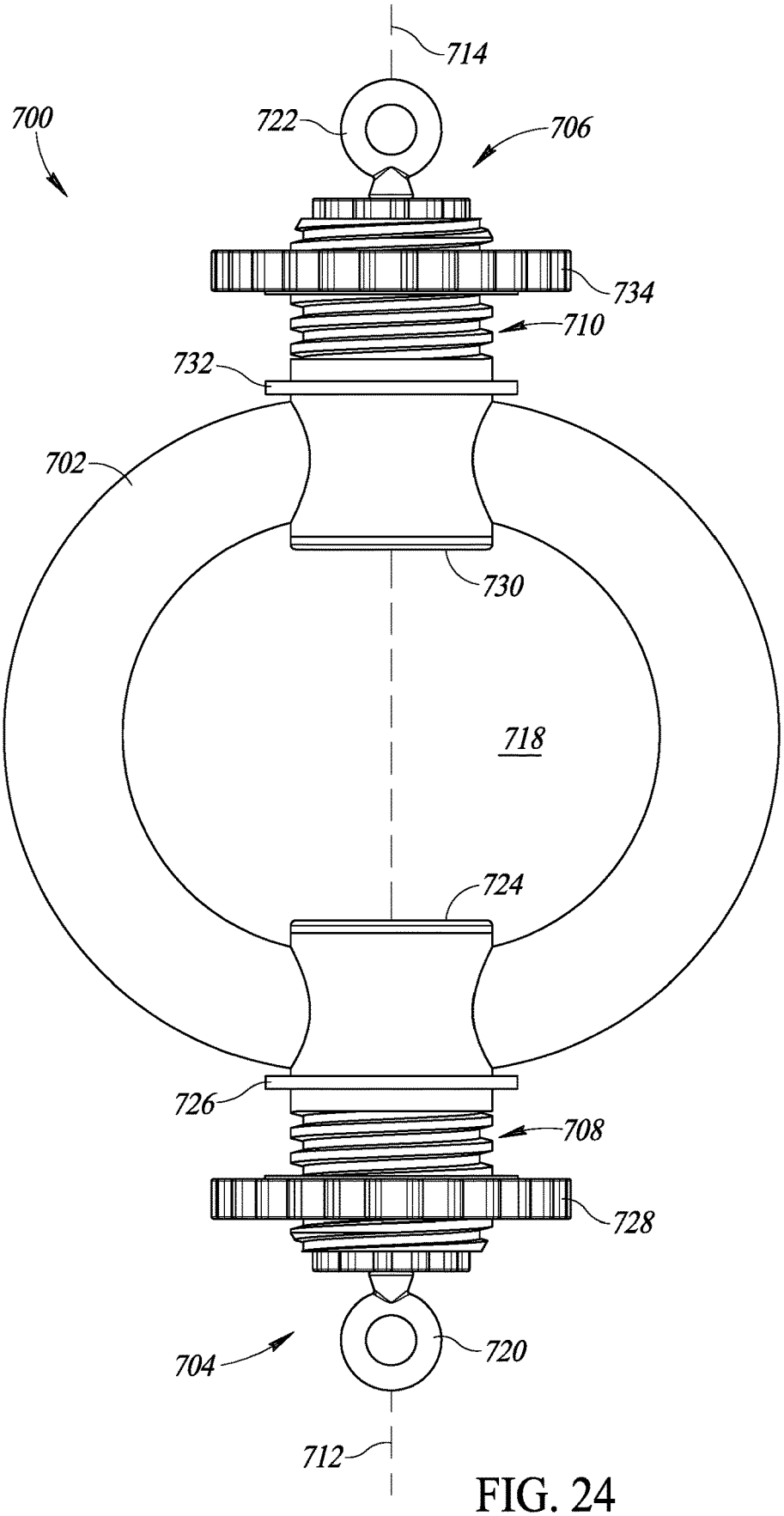
FIG. 24 depicts a front view of the exercise system of FIG. 14, according to one or more embodiments disclosed herein.
Figure 25:
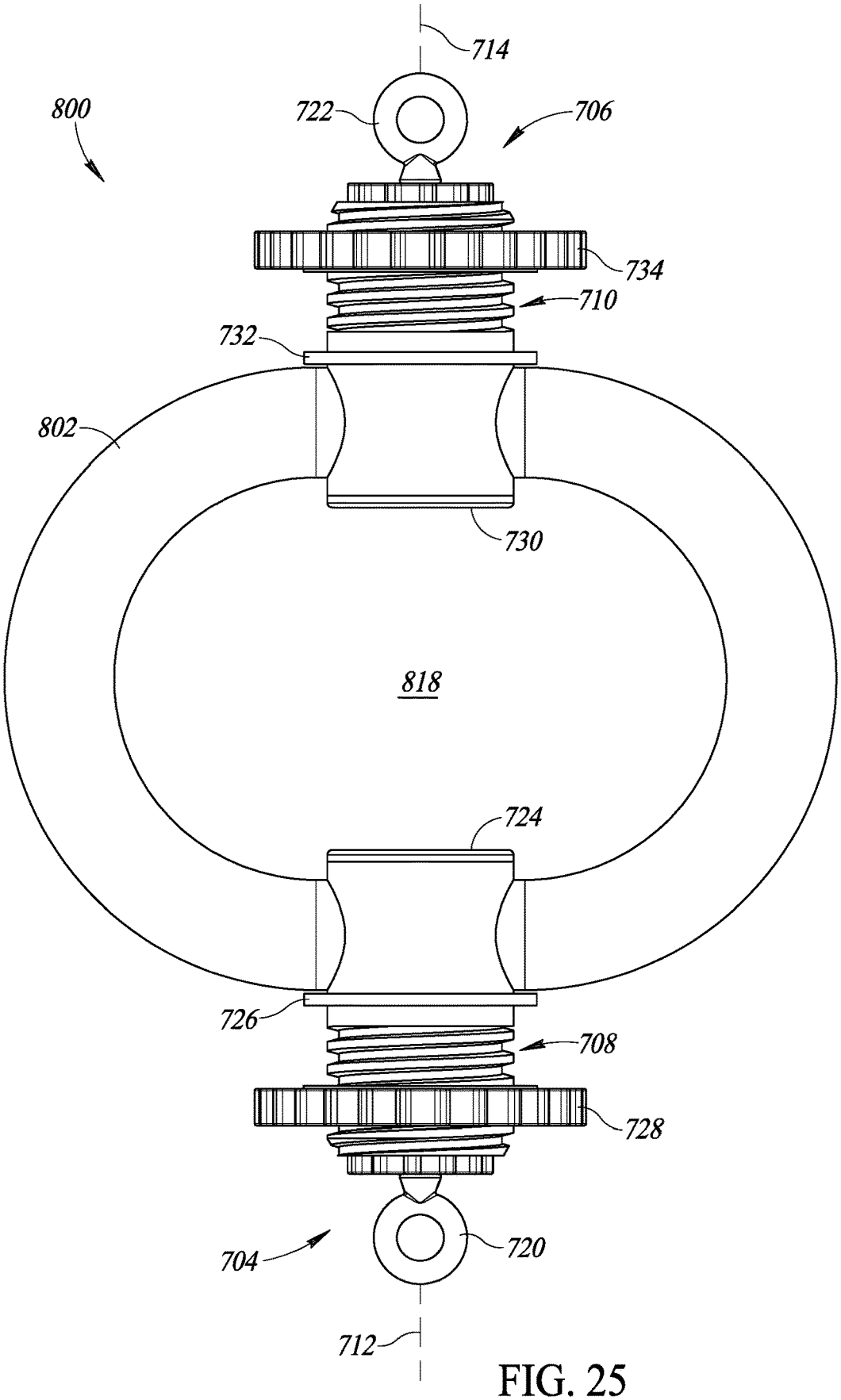
FIG. 25 depicts a front view of the exercise system of FIG. 15, according to one or more embodiments disclosed herein.

The first end cap 704 is removably coupled to the handle 702 at a distal end of a first stub or coupling 708, which can be a hollow cylinder having left-handed or right-handed threads 703 on an interior surface thereof (see FIG. 16) and left-handed or right-handed threads 705 on an exterior surface thereof (see FIG. 16), and which extends radially away from the rest of the handle 702 in a first direction. The handedness of the interior threads 703 can be the same as or opposite to the handedness of the exterior threads 705. The first end cap 704 has left-handed or right-handed threads 736 (see FIGS. 31 and 32) complementary to the interior threads 703 of the first coupling 708, and is threaded into the hollow cylinder of the first coupling 708.

The second end cap 706 is removably coupled to the handle 702 at a distal end of a second stub or coupling 710 located opposite to the first coupling 708 across a diameter of the handle 702, which can be a hollow cylinder having left-handed or right-handed threads corresponding to threads 703 on an interior surface thereof and left-handed or right-handed threads 707 on an exterior surface thereof (see FIG. 16), and extends radially away from the rest of the handle 702 in a second direction opposite to the first direction. The handedness of the interior threads can be the same as or opposite to the handedness of the exterior threads 707. Further, the handedness of the interior threads 703 of the first end cap 704 can be the same as the handedness of the interior threads of the second end cap 706, and the handedness of the exterior threads 705 of the first end cap 704 can be the same as the handedness of the exterior threads 707 of the second end cap 706. The second end cap 706 has threads 736 (see FIGS. 31 and 32) complementary to the interior threads of the second coupling 710, and is threaded into the hollow cylinder of the second coupling 710. The first and second couplings 708, 710 can be structurally identical to one another.

The first end cap 704, the first inner cap 724, the first washer plate 726, the first collar 728, and the first coupling 708 have a common first central longitudinal axis 712 and the second end cap 706, the second inner cap 730, the second washer plate 732, the second collar 734, and the second coupling 710 have a common second central longitudinal axis 714 that is coincident with the first central longitudinal axis 712. The handle 702 forms a ring having an aperture 718 at its center, with a central longitudinal axis 716 of the ring and its aperture 718 extending perpendicularly to the first and second central longitudinal axes 712, 714 of the first and second end caps 704, 706. The handle 702 and its aperture 718 are sized so that a user can grasp the handle 702 by putting their fingers, a hand, or an arm through its aperture 718.

The first inner cap 724 can have a cylindrical shape and is removably coupled, such as by an adhesive or a mechanical coupling such as a press fit, to the handle 702 at a proximal end of the first coupling 708. Similarly, the second inner cap 730 can have a cylindrical shape and is removably coupled, such as by an adhesive or a mechanical coupling such as a press fit, to the handle 702 at a proximal end of the second coupling 708. In other implementations, the first and second inner caps 724 and 726 are not removably coupled to the handle 702 and are instead permanently affixed thereto, such as by an adhesive, welding, etc.

The first washer plate 726 is positioned on and extends about the first coupling 708 at a proximal location with respect to the first collar 728, and the second washer plate 732 is positioned on and extends about the second coupling 710 at a proximal location with respect to the second collar 734. The first collar 728 is threadedly engaged with the exterior threads 705 of the first coupling 708 at a distal location with respect to the first washer plate 728, thereby locking the first washer plate 726 on the first coupling 708. The second collar 734 is threadedly engaged with the exterior threads 707 of the second coupling 710 at a distal location with respect to the second washer plate 732, thereby locking the second washer plate 732 on the second coupling 710.

FIGS. 16, 19, 22, and 26 illustrate perspective, side, end, and front views of the handle 702 of the modular fitness system 700 separated from other components of the modular fitness system 700. As illustrated, the hollow cylindrical shapes of the first and second couplings 708 and 710 extend from the respective proximal ends of the couplings 708 and 710 to the respective distal ends of the couplings 708 and 710. Thus, when the other components of the modular fitness system 700 are removed from the handle 702, an open space or conduit 738 extends all the way from the distal end of the coupling 708 to the distal end of the coupling 710 (see FIG. 22).

FIGS. 15, 18, 21, and 25 illustrate perspective, side, end, and front views of a modular fitness system 800 that is identical to the modular fitness system 700, except that it includes a handle 802 with an aperture 818 having a different shape than the handle 702 and its aperture 718. The fitness system 800 includes the handle 802, the first end cap 704, the first inner cap 724, the first washer plate 726, and the first nut or collar 728 coupled to the handle 702, as well as the second end cap 706, the second inner cap 730, the second washer plate 732, and the second nut or collar 734 coupled to the handle 702. FIGS. 17, 19, 23, and 27 illustrate perspective, side, end, and front views of the handle 802 of the modular fitness system 800 separated from other components of the modular fitness system 800. The modular fitness system 800 and the components thereof have the same features, structures, uses, and applications as the modular fitness system 700 and the components thereof, except as described herein with regard to the handle 802 having a different shape than the handle 702.

Figure 26:
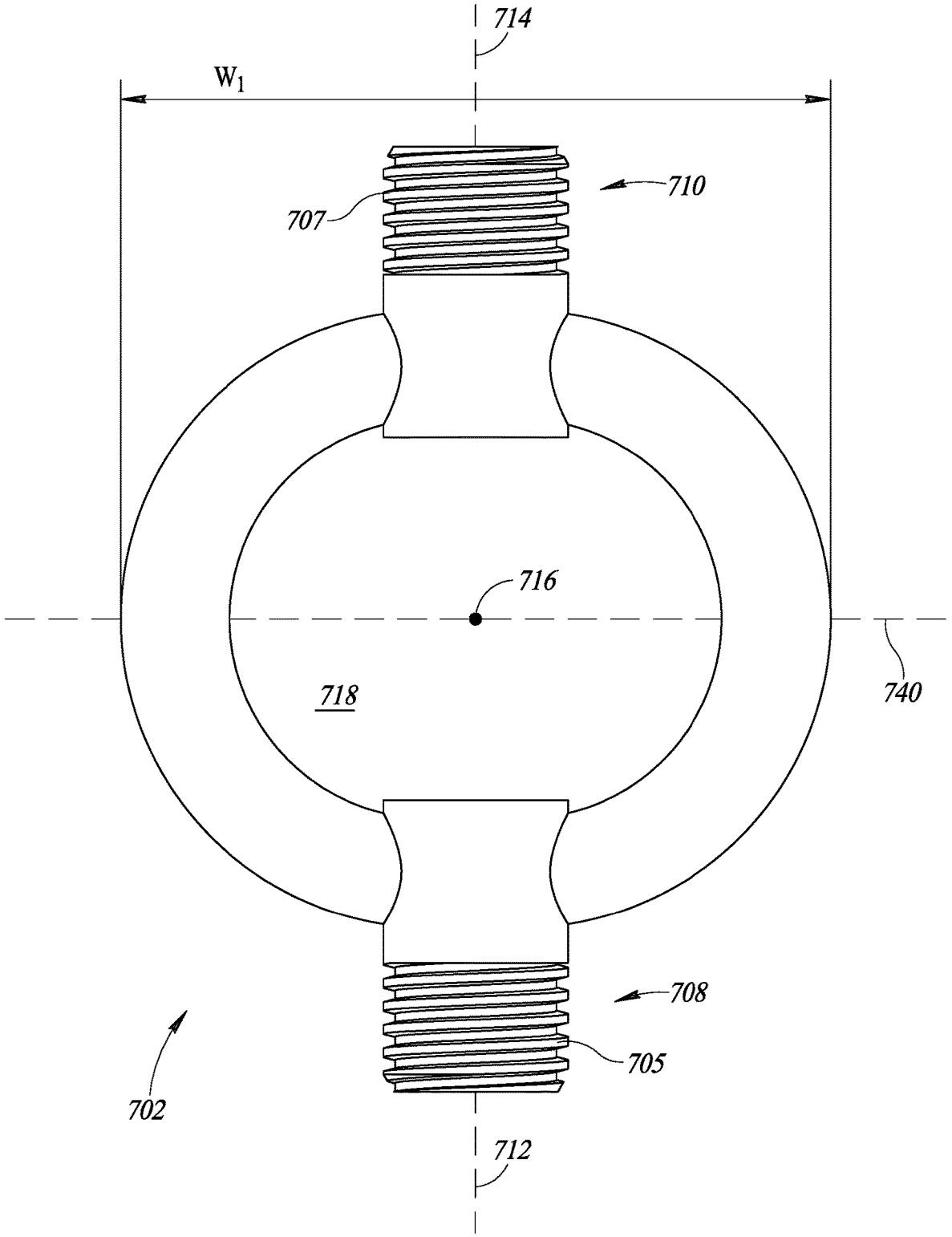
FIG. 26 depicts a front view of the handle portion of the exercise system of FIG. 14, according to one or more embodiments disclosed herein.
Figure 27:
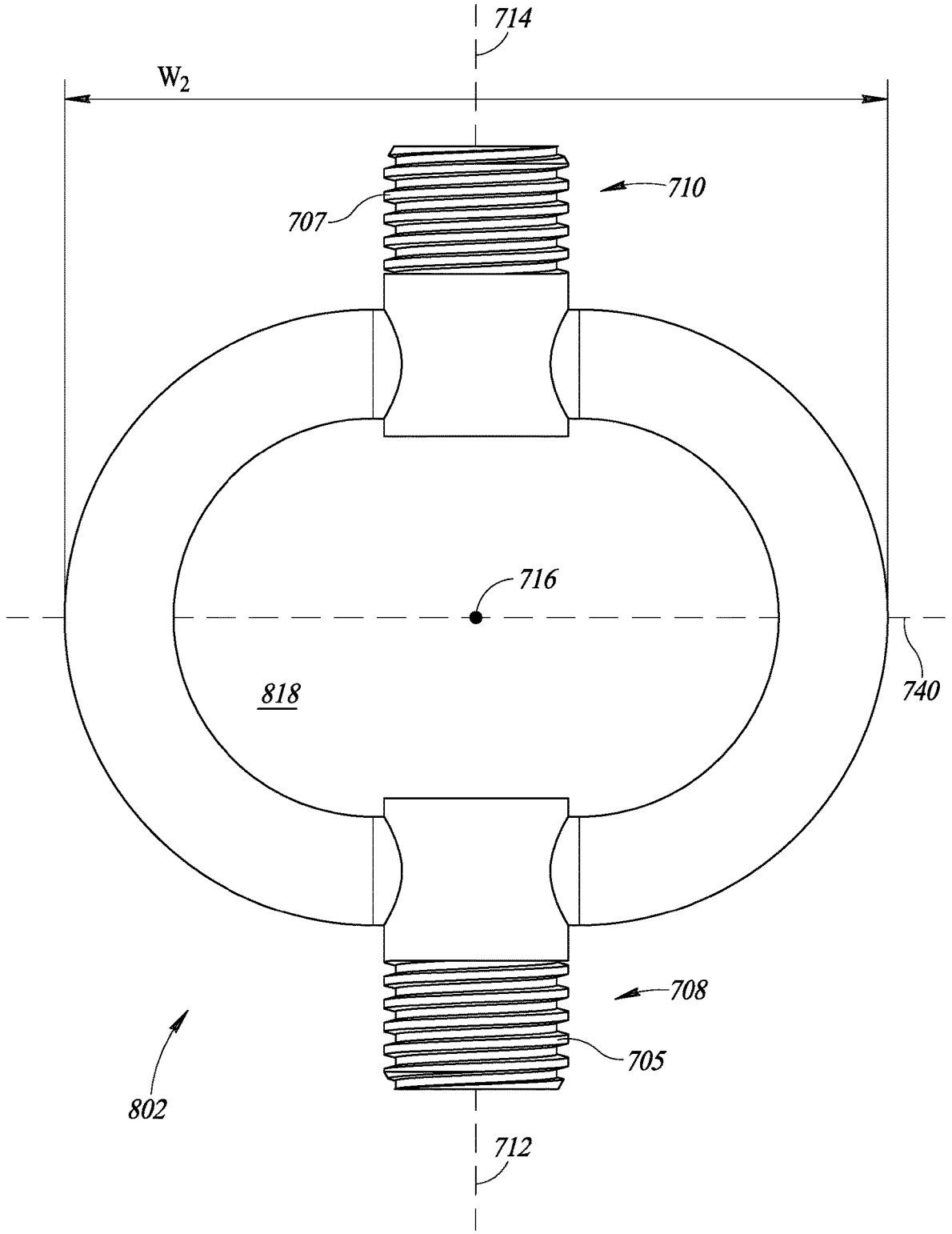
FIG. 27 depicts a front view of the handle portion of the exercise system of FIG. 15, according to one or more embodiments disclosed herein.

As illustrated in FIG. 26, the handle 702 has a first overall or outer width W1 in a dimension extending perpendicular to the first central longitudinal axis 712, perpendicular to the second central longitudinal axis 714, and perpendicular to the central longitudinal axis 716. As illustrated in FIG. 27, the handle 802 has a second overall or outer width W2 in a dimension extending perpendicular to the first central longitudinal axis 712, perpendicular to the second central longitudinal axis 714, and perpendicular to the central longitudinal axis 716. As illustrated by a comparison of FIG. 26 with 27, the first width W1 is less than or smaller than the second width W2. Thus, the handle 802 is wider than the handle 702, and while the aperture 718 has an overall substantially circular shape, the aperture 818 has an overall oval or elliptical shape, or a shape including a rectangle with semicircles at opposing ends thereof. All other dimensions and properties of the system 800 and handle 802 are the same as those of the system 700 and handle 702.

Figure 29:
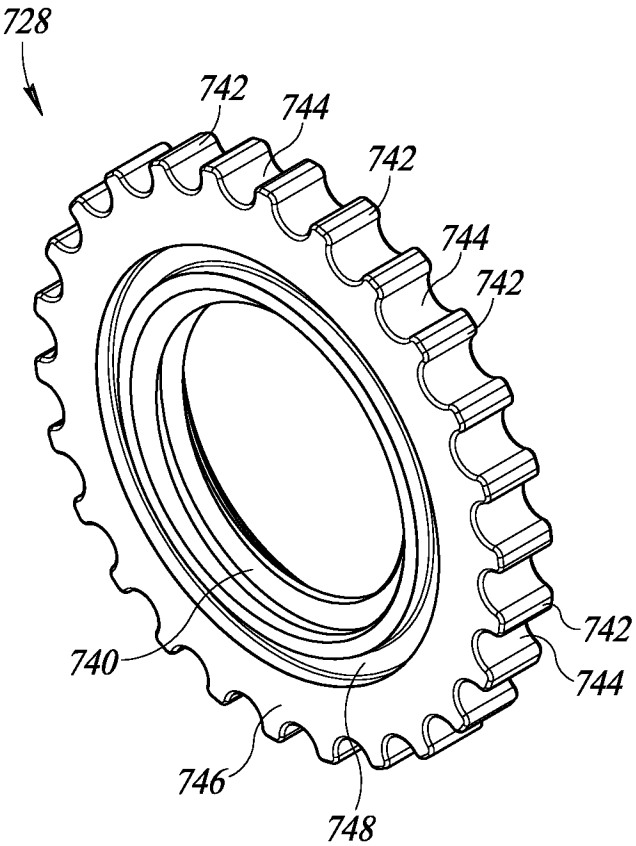
FIG. 29 depicts a perspective view of a collar of the exercise systems of FIGS. 14 and 15, according to one or more embodiments disclosed herein.
Figure 28:
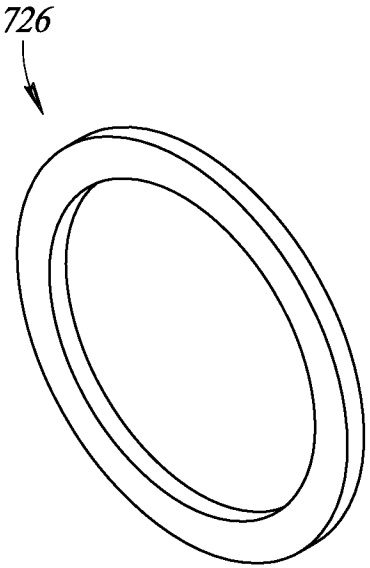
FIG. 28 depicts a perspective view of a washer plate of the exercise systems of FIGS. 14 and 15, according to one or more embodiments disclosed herein.

FIG. 28 illustrates the first washer plate 726 separated from other components of the modular exercise system 700. As illustrated in FIG. 28, the first washer plate 726 is a hollow disk, or has an overall annular shape, where a cross-sectional shape of the annular structure of the first washer plate 726 is rectangular and constant along its circular length. The second washer plate 732 has a structure identical to the structure of the first washer plate 726. FIG. 29 illustrates the first collar 728 separated from other components of the modular exercise system 700. As illustrated in FIG. 29, the first collar 728 is a hollow disk, or has an overall annular shape. An inner surface of the first collar 728 has left-handed or right-handed threads 740 that are complementary to the threads 705 and 707 so that the first collar 728 can be threaded onto the first or the second coupling 708, 710. An outer surface of the first collar 728 has a plurality of ridges 742 alternating with a plurality of grooves 744 about the annular structure of the first collar 728. Together, the ridges 742 and the grooves 744 provide a plurality of knobs or a gripping surface to increase traction between the first collar 728 and a user's hand while the user threads the first collar 728 onto or off of the first or the second coupling 708, 710.

Figure 30:
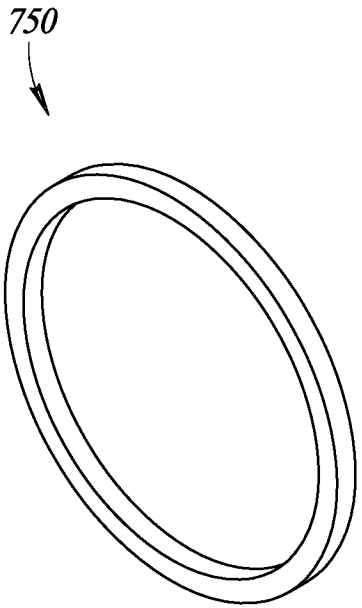
FIG. 30 depicts a perspective view of a gasket of the exercise systems of FIGS. 14 and 15, according to one or more embodiments disclosed herein.

A front or end face or a major surface 746 of the first collar 728, which forms a proximal end of the first collar 728, includes a groove 748 that extends into the major surface 746 and in a circle within the major surface 746 between the inner, threaded surface and the outer, ridged surface of the first collar 728. The groove 748 is sized and configured to receive a gasket or other sealing component. The second collar 734 has a structure identical to the structure of the first collar 734. FIG. 30 illustrates a gasket 750 of the exercise system 700 separated from other components of the modular exercise system 700. As illustrated in FIG. 30, the gasket 750 is an O-ring and has an overall annular shape, where a cross-sectional shape of the annular structure of the gasket 750 is rectangular and constant along its circular length. The gasket 750 is sized and configured to be seated within the groove 748 in the major surface 746 of the first collar 728, and can be coupled therein by an adhesive or by a mechanical coupling such as a press fit. The exercise system 700 can include two of such gaskets 750, one positioned within a respective groove 748 of each of the first and second collars 728, 734.

Figure 31:
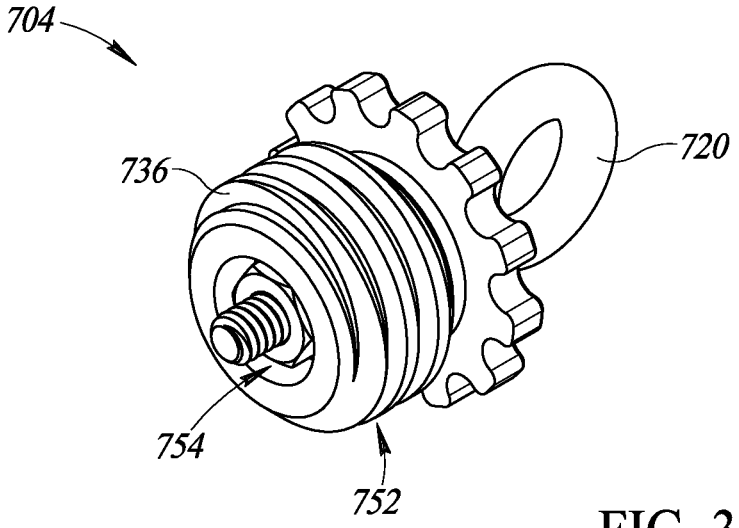
FIG. 31 depicts a perspective view of an end cap of the exercise systems of FIGS. 14 and 15, according to one or more embodiments disclosed herein.
Figure 32:
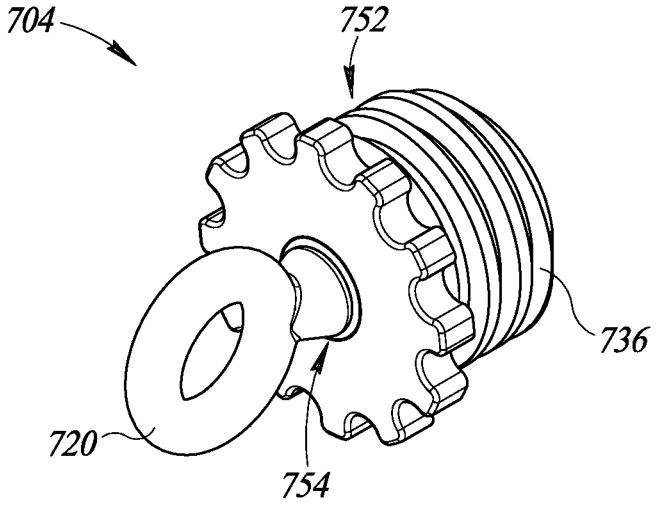
FIG. 32 depicts another perspective view of the end cap of the exercise systems of FIGS. 14 and 15, according to one or more embodiments disclosed herein.
Figure 33:
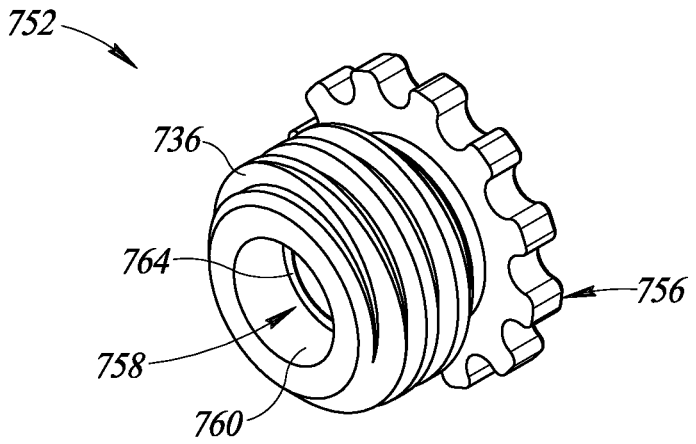
FIG. 33 depicts a perspective view of a main body of the end cap of the exercise systems of FIGS. 14 and 15, according to one or more embodiments disclosed herein.
Figure 34:
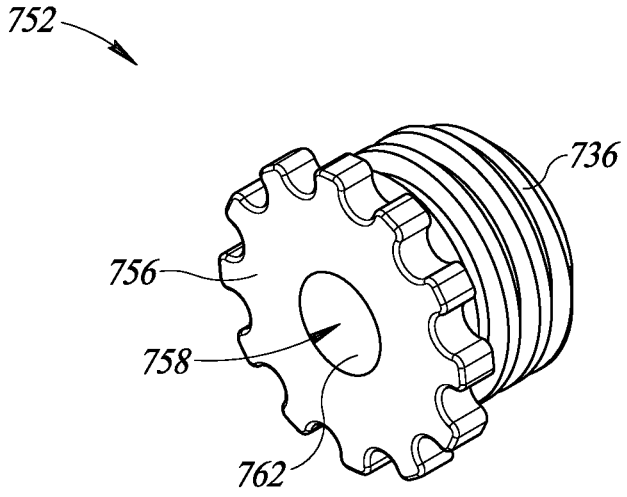
FIG. 34 depicts another perspective view of the main body of the end cap of the exercise systems of FIGS. 14 and 15, according to one or more embodiments disclosed herein.

FIGS. 31 and 32 illustrate two different perspective views of the first end cap 704 separated from other components of the exercise system 700. As illustrated in FIGS. 31 and 32, the first end cap 704 includes an outer housing or main body 752 and an eye bolt assembly 754 thereof. FIGS. 33 and 34 illustrate two different perspective views of the main body 752 of the end cap 704. As illustrated in FIGS. 33 and 34, the main body 752 includes a hollow cylinder having a proximal portion with an outer surface including the threads 736 corresponding to the interior threads (e.g., interior threads 703) of the first and second coupling 708, 710.

The hollow cylindrical structure of the main body 752 also includes a distal flanged portion 756, where an outer surface of the distal flanged portion 756 has a plurality of ridges alternating with a plurality of grooves about the outer surface of the distal flanged portion 756. The ridges and grooves of the flanged portion 756 can have the same structures as the ridges 742 and the grooves 744 of the first collar 728, and provide a plurality of knobs or a gripping surface to increase traction between the main body 752 and a user's hand while the user threads the first end cap 704 into or out of the first or the second coupling 708, 710. As also illustrated in FIGS. 33 and 34, the hollow cylindrical structure of the main body 752 includes an internal conduit 758 extending along a length of the main body 752, where a proximal portion 760 of the conduit 758 has a larger diameter than a distal portion 762 of the conduit. Thus, a step change in the diameter of the conduit 758 or a shoulder 764 is formed between the proximal and distal portions of the conduit 758, where the shoulder 764 faces toward a proximal end of the main body 752.

Figure 35:
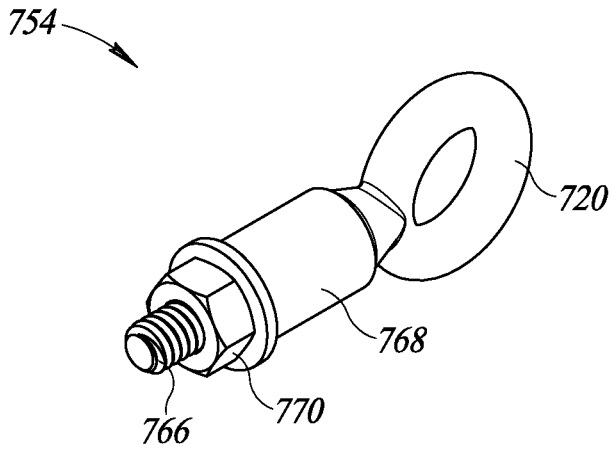
FIG. 35 depicts a perspective view of an eye bolt assembly of the end cap of the exercise systems of FIGS. 14 and 15, according to one or more embodiments disclosed herein.
Figure 36:
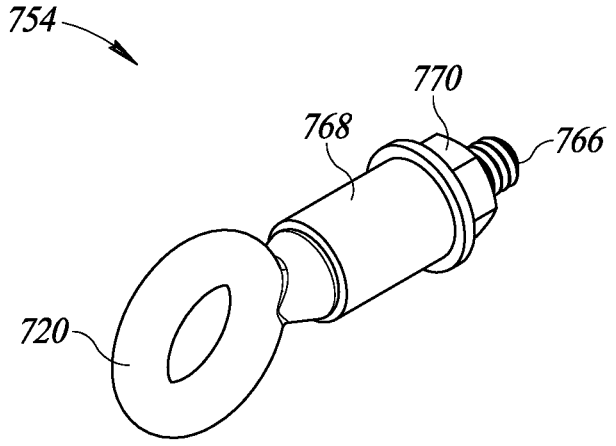
FIG. 36 depicts another perspective view of the eye bolt assembly of the end cap of the exercise systems of FIGS. 14 and 15, according to one or more embodiments disclosed herein.

FIGS. 35 and 36 illustrate two different perspective views of the eye bolt assembly 754 of the first end cap 704 separated from other components of the exercise system 700. As illustrated in FIGS. 35 and 36, the eye bolt assembly 754 includes a flanged annular bearing sleeve 768, an eyebolt 766 extending through the sleeve 768, and a nut 770 threaded onto a threaded end of the eye bolt 766. The nut 770 captures the sleeve 768 and retains the sleeve 768 on a threaded portion of the eye bolt 766 between the nut 770 and a ring 720 of the eye bolt 766 located at an end of the eyebolt 766 opposite to the threaded end of the eye bolt 766.

Figure 37:
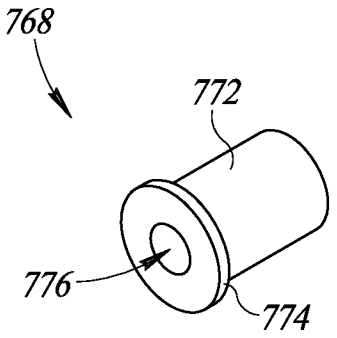
FIG. 37 depicts a perspective view of a bearing sleeve of the end cap of the exercise systems of FIGS. 14 and 15, according to one or more embodiments disclosed herein.
Figure 38:
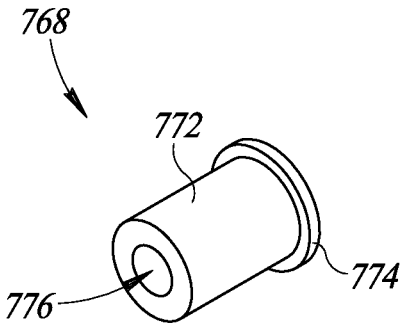
FIG. 38 depicts another perspective view of the bearing sleeve of the end cap of the exercise systems of FIGS. 14 and 15, according to one or more embodiments disclosed herein.
Figure 39:
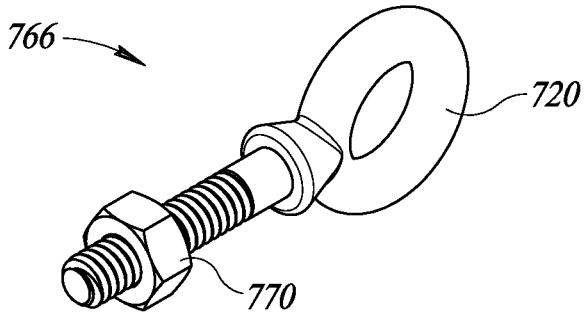
FIG. 39 depicts a perspective view of an eye bolt of the end cap of the exercise systems of FIGS. 14 and 15, according to one or more embodiments disclosed herein.

FIGS. 37 and 38 illustrate two different perspective views of the flanged annular bearing sleeve 768. As illustrated in FIGS. 37 and 38, the bearing sleeve 768 includes a hollow cylindrical body having an internal open space or conduit 776 extending through a center and along a length of the bearing sleeve 768. The bearing sleeve 768 also includes a distal portion 772 having a constant outer diameter and a proximal flange 774 extending radially outward with respect to the distal portion 772 and having a larger outer diameter than the distal portion 772. FIG. 39 illustrates a perspective view of the eye bolt 766 and the nut 770 threaded onto the threaded portion of the eye bolt 766. The second end cap 706 has components, features, and structures, including a ring 722 corresponding to the ring 720, similar or identical to the corresponding components, features, and structures of the first end cap 704.

A method of assembling the system 700 includes assembling the first end cap 704 by positioning a bearing sleeve 768 within an internal conduit 758 of a respective main body 752 with a distal surface of the proximal flange 774 of the bearing sleeve 768 engaged with the shoulder 764 within the internal conduit 758 of the respective main body 752. The method further includes positioning an eye bolt 766 through the main body 752 and the bearing sleeve 768 such that the ring 720 of the eye bolt 766 is engaged with a distal end of the main body 752 and the threaded end of the eye bolt 766 extends out of a proximal end of the conduit 776 of the bearing sleeve 768 and out of a proximal end of the internal conduit 758 of the main body 752. The method further includes threading the nut 770 onto the threaded end of the eye bolt 766.

Doing so locks the components of the first end cap 704 to one another. In particular, the nut 770 is threaded onto and thereby locked to the eye bolt 766, thereby locking the bearing sleeve 768 to the eye bolt 766 as described above. The eye bolt 766, the nut 770, and the bearing sleeve 768 are then locked to the main body 752 by the engagement of the distal surface of the proximal flange 774 of the bearing sleeve 768 with the shoulder 764 within the internal conduit 758 of the respective main body 752, and by the engagement of the ring 720 of the eye bolt 766 with a distal end of the main body 752. Nevertheless, the eye bolt 766 can rotate about its central longitudinal axis, which can be coincident with the axes 712 and 714, with respect to other components of the system 700.

The method of assembling the system 700 also includes assembling the second end cap 706 in a manner similar or identical to that described above for the first end cap 704. The method of assembling the system 700 also includes threading the first and second end caps 704, 706 into the first and second couplings 708, 710, positioning the first and second washer plates 726, 732 onto the first and second couplings 708, 710, threading the first and second collars 728, 734 onto the first and second couplings 708, 710, and/or coupling the first and second inner caps 724, 730 to the first and second couplings 708, 710. The system 700 can be disassembled by taking its components apart in a sequence opposite to that described herein for its assembly.

Figure 14:
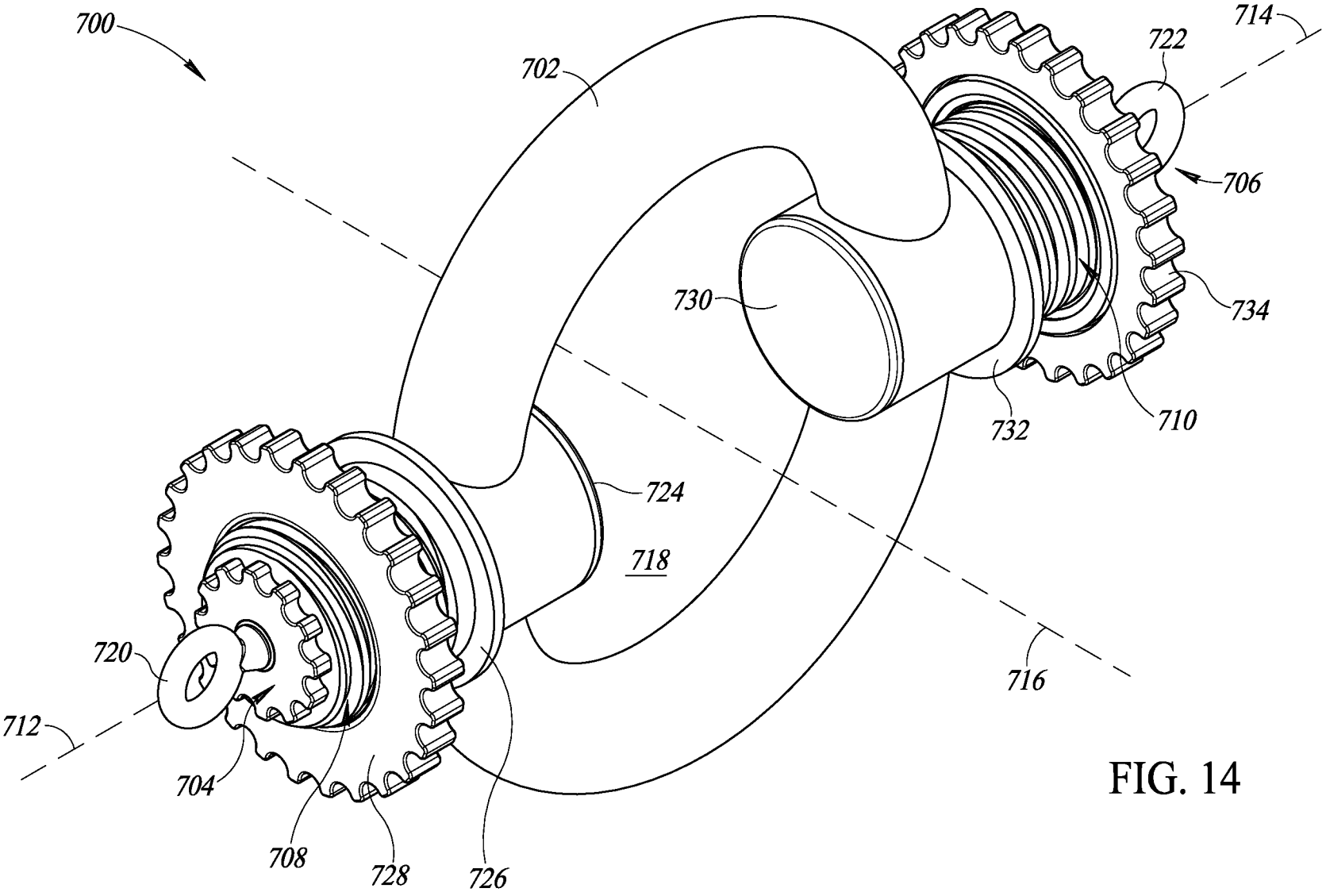
FIG. 14 depicts a perspective view of an exercise system, according to one or more embodiments disclosed herein.
Figure 15:
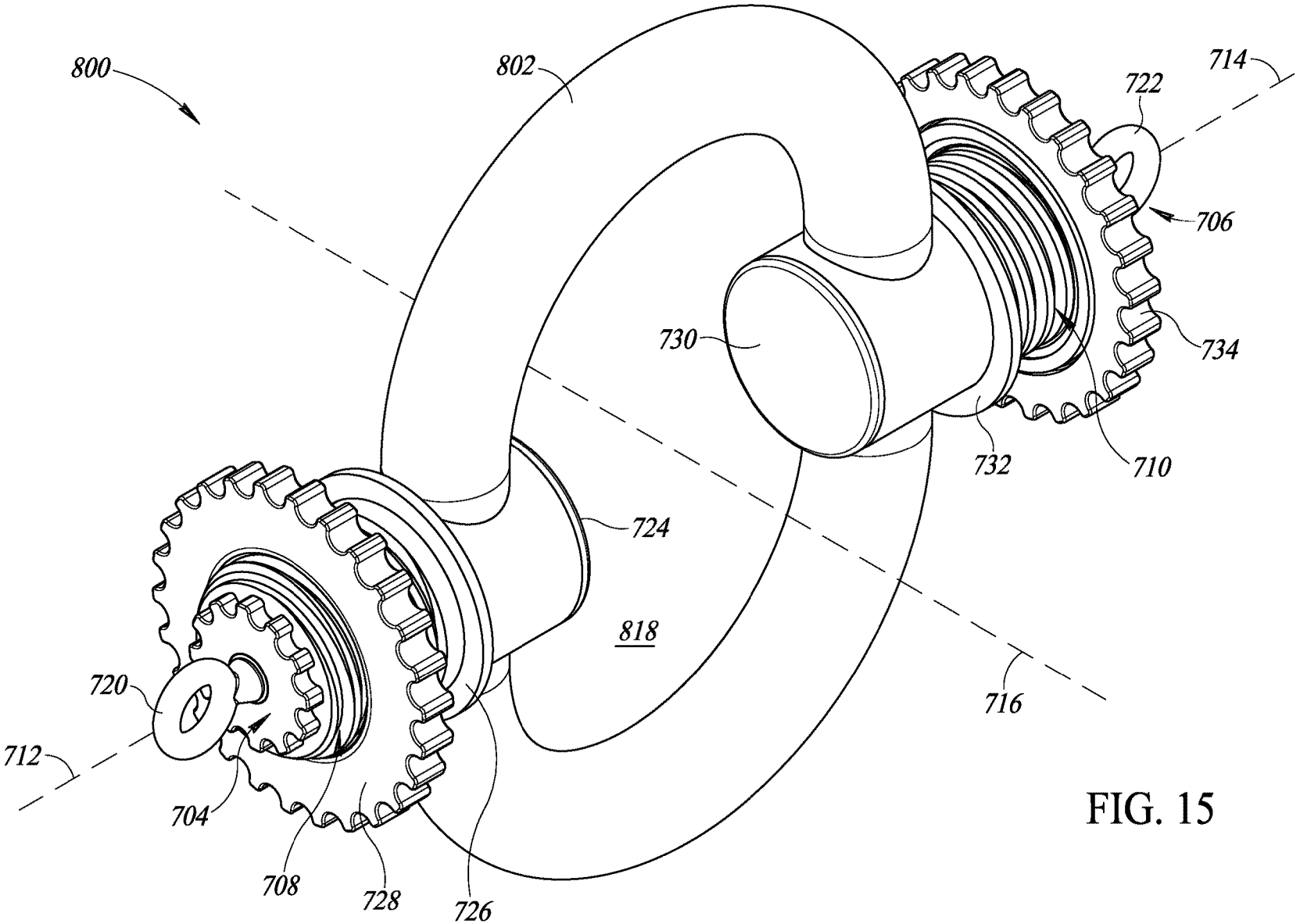
FIG. 15 depicts a perspective view of another exercise system, according to one or more embodiments disclosed herein.

A method of using the system 700 can include assembling the system 700 and coupling one or more plate weights to the system 700 as described above with respect to the system 600 in the "kettlebell" configuration, and using the system 700 as described above for the system 600 in the "kettlebell" configuration. In particular, FIG. 14 illustrates that the system 700 can be provided in a "kettlebell" configuration. The first and second couplings 708 and 710 can have dimensions matching standard barbell ends or Olympic barbell sleeves, so that standard-sized or Olympic-sized plate weights (see the phantom lines in FIG. 8) can be loaded onto the first and second couplings 708, 710 between the respective washer plate 726, 732 and the respective collar 728, 734, so that a user can use the system 700 in the kettlebell configuration as though it were a kettlebell or a dumbbell.

In some implementations, the first and second couplings 708 and 710 can have cylindrical outer surfaces with outer diameters of about 4.95 cm or about 5.00 cm to replicate the ends or sleeves of an Olympic bar. Further, the washer plates 726, 732 provide proximal bearing surfaces for the plate weights, and the collars 728, 734 provide distal bearing surfaces for the plate weights. The gaskets 750 can be engaged with distal end surfaces of the plate weights to provide resistance to the collars 728, 734 becoming loose by threading distally along the couplings 708, 710 away from the plate weights.

When using the system 700 in the "kettlebell" configuration, a user can hold the system 700 in different configurations to customize his or her workout. For example, the user can hold the system 700 by the handle 702 with his or her arm outside of and extending away from the handle 702 and with the rest of the system 700 hanging from the handle 702. As another example, the user can hold the system 700 by a first side of the handle 702 with his or her arm extending through the handle 702 and/or toward a second side of the handle 702 opposite to the first side.

Another method of using the system 700 can include assembling the system 700 and coupling a first end of an elastic band to the ring 720 of the first end cap 704 and a second end of the elastic band opposite its first end to the ring 722 of the second end cap 706, in a manner similar to that described above with respect to the system 600, and using the system 700 as described above for the system 600. In particular, FIG. 14 illustrates that the first end cap 704 includes a coupling such as the ring 720 at its distal end, to which a first end of an elastic member can be coupled, and that the second end cap 706 includes a coupling such as the ring 722 at its distal end, to which a second end of the elastic member can be coupled. The first and second end caps 704, 706 and their respective rings 720 and 722 can be structurally identical to one another.

Another method of using the system 700 can include assembling the system 700 except for the first and second end caps 704 and 706, coupling a first flexible bow or rod to the handle 702, such as by threading the first flexible bow or rod into the interior threads within the first coupling 708, and coupling a second flexible bow or rod to the handle 702, such as by threading the second flexible bow or rod into the interior threads within the second coupling 710. The method can further include using the system 700 by shaking the handle 700 back and forth to cause the first and second flexible bows to oscillate. In some implementations, the first and second flexible bows can be made of fiberglass.

U.S. Pat. No. 9,713,734, U.S. patent application Ser. No. 15/585,050, and PCT Application No. PCT/US17/30677 are hereby incorporated herein by reference in their entireties. Aspects and features of the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. An exercise device, comprising:

a ring-shaped handle including an opening extending through a center of the ring-shaped handle;

a first coupling at a first location, the first coupling having a first threaded outer surface with a first outer diameter of about 5 cm and a first threaded inner surface; and a second coupling at a second location opposite to the first location across a diameter of the ring-shaped handle, the second coupling having a second threaded outer surface with a second outer diameter of about 5 cm and a second threaded inner surface.

2. The exercise device of claim 1 wherein the first threaded inner surface is threaded in a direction opposite to the first threaded outer surface.

3. The exercise device of claim 2 wherein the second threaded inner surface is threaded in a direction opposite to the second threaded outer surface.

4. The exercise device of claim 3 wherein the first threaded inner surface is threaded in a direction the same as the second threaded inner surface and the first threaded outer surface is threaded in a direction the same as the second threaded outer surface.

5. The exercise device of claim 4 wherein the first and second threaded inner surfaces have left-handed threads and the first and second threaded outer surfaces have right-handed threads.

6. The exercise device of claim 1, further comprising a first collar threaded onto the first threaded outer surface and a second collar threaded onto the second threaded outer surface.

7. The exercise device of claim 1, further comprising a first end cap threaded into the first threaded inner surface and a second end cap threaded into the second threaded inner surface.

8. The exercise device of claim 1 wherein the ring-shaped handle is configured to be grasped by a human hand extending through the opening at the center of the handle.

9. The exercise device of claim 1 wherein a first central longitudinal axis of the first coupling extends in a first radial direction away from the center of the handle and a second central longitudinal axis of the second coupling extends in a second radial direction away from the center of the handle.

10. The exercise device of claim 9 wherein the ring-shaped handle lies in a plane that includes the first central longitudinal axis and the second central longitudinal axis.

11. An exercise device, comprising:

a ring-shaped handle including an opening extending through a center of the ring-shaped handle;

a first coupling at a first location, the first coupling having a first threaded inner surface;

a second coupling at a second location opposite to the first location across a diameter of the ring-shaped handle, the second coupling having a second threaded inner surface;

a first end cap threaded into the first threaded inner surface; and a second end cap threaded into the second threaded inner surface.

12. The exercise device of claim 11 wherein the first end cap has a first distal end and includes a first ring at the first distal end.

13. The exercise device of claim 12 wherein the first ring has a first central longitudinal axis and is rotatable with respect to the ring-shaped handle about the first central longitudinal axis.

14. The exercise device of claim 13 wherein the second end cap has a second distal end and includes a second ring at the second distal end.

15. The exercise device of claim 14 wherein the second ring has a second central longitudinal axis that is coincident with the first central longitudinal axis and is rotatable with respect to the ring-shaped handle about the second central longitudinal axis.

16. The exercise device of claim 11 wherein the first end cap is positioned within and threaded into a conduit that extends through the first coupling and the second coupling.

17. The exercise device of claim 16 wherein the second end cap is positioned within and threaded into the conduit that extends through the first coupling and the second coupling.

18. The exercise device of claim 11 wherein the ring-shaped handle is configured to be grasped by a human hand extending through the opening at the center of the handle.

19. The exercise device of claim 11 wherein a first central longitudinal axis of the first coupling extends in a first radial direction away from the center of the handle and a second central longitudinal axis of the second coupling extends in a second radial direction away from the center of the handle.

20. The exercise device of claim 19 wherein the ring-shaped handle lies in a plane that includes the first central longitudinal axis and the second central longitudinal axis.

* * * * *